US006601820B2

(12) United States Patent
Gates

(10) Patent No.: US 6,601,820 B2
(45) Date of Patent: Aug. 5, 2003

(54) GANG FORM FOR USE WITH A CONCRETE FORM SYSTEM AND METHOD OF BUILDING A GANG FORM

(75) Inventor: H. Gordon Gates, Denver, CO (US)

(73) Assignee: Gates & Sons, Inc., Denver, CO (US)

( * ) Notice: Subject to any disclaimer, the term of this patent is extended or adjusted under 35 U.S.C. 154(b) by 82 days.

(21) Appl. No.: 10/012,014

(22) Filed: Oct. 29, 2001

(65) Prior Publication Data

US 2002/0121586 A1 Sep. 5, 2002

Related U.S. Application Data

(63) Continuation-in-part of application No. 09/484,486, filed on Jan. 18, 2000, which is a continuation-in-part of application No. 09/229,859, filed on Jan. 13, 1999, now Pat. No. 6,024,339.

(51) Int. Cl.[7] ..... E04G 11/08; E04G 17/06; B23P 11/00

(52) U.S. Cl. ..... 249/191; 249/45; 249/47; 249/219.2; 29/469; 29/525.02

(58) Field of Search ..... 249/45, 47, 190, 249/191, 219.2, 193; 52/745.09, 745.2; 29/469, 525.02, 525.03, 525.04, 897.3, 897.32

(56) References Cited

U.S. PATENT DOCUMENTS

| | | | | | |
|---|---|---|---|---|---|
| 2,107,427 | A | * | 2/1938 | Schwarzler | 249/193 |
| 2,332,166 | A | | 10/1943 | Reiner | |
| 2,526,529 | A | * | 10/1950 | Arrighini et al. | 249/38 |
| 3,452,960 | A | * | 7/1969 | Bowden | 249/40 |
| 3,751,790 | A | * | 8/1973 | Frazier | 29/464 |
| 4,030,694 | A | * | 6/1977 | Schimmel | 249/47 |
| 4,033,544 | A | * | 7/1977 | Johnston | 249/190 |
| 4,151,975 | A | | 5/1979 | Williams | |
| 4,192,481 | A | | 3/1980 | Durbin | |
| 4,211,385 | A | | 7/1980 | Johanson et al. | |
| 4,254,932 | A | | 3/1981 | Durbin | |
| 4,473,209 | A | | 9/1984 | Gallis et al. | |
| 4,811,927 | A | | 3/1989 | Slonimsky et al. | |
| 5,620,628 | A | * | 4/1997 | Ritchie, IV | 249/193 |
| 5,799,399 | A | * | 9/1998 | Schultz | 249/44 |
| 5,855,807 | A | * | 1/1999 | Hsieh | 249/45 |
| 5,965,053 | A | * | 10/1999 | Carlson | 249/191 |

FOREIGN PATENT DOCUMENTS

| | | | | |
|---|---|---|---|---|
| GB | 589664 | * | 6/1947 | 249/193 |

* cited by examiner

*Primary Examiner*—Michael Safavi
(74) *Attorney, Agent, or Firm*—Dorr, Carson, Sloan, & Birney, P.C.

(57) ABSTRACT

A gang form for use with a concrete form system is provided. The concrete form system has a plurality of said gang forms and a plurality of tie rods. An improved insert having four sides is positioned between two adjacent form panels having flanges with flange openings therein. Side openings in the third and fourth sides of the insert are aligned with the flange openings. Attachment devices are inserted in the side openings and flange openings to attach the insert to the two adjacent form panels and to provide the gang form. At least one lock member is rotatably attached to the second side of the improved insert. One of the plurality of tie rods extends through a tie rod opening in the first and second sides of the insert and is firmly secured to the insert by moving the lock member from an unlocked position to a locked position. Thus, the gang form is interconnected to the concrete form system.

17 Claims, 31 Drawing Sheets

10
100
200
202
204
206
300
302
304
308
312
316
318
400
500
600
700
702
804
306
3

Fig. 5(a)
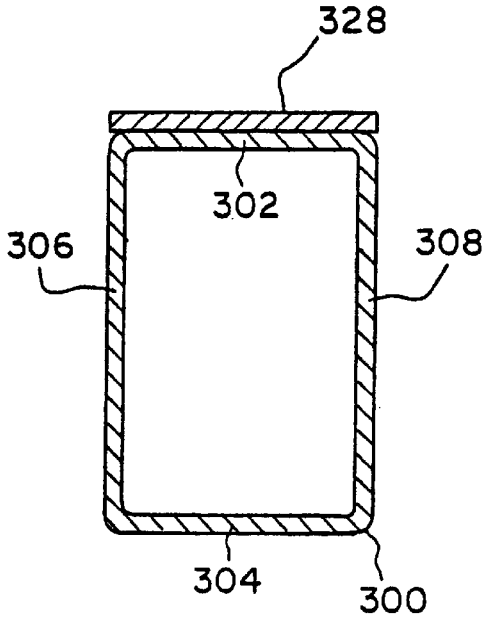
Fig. 5(b)
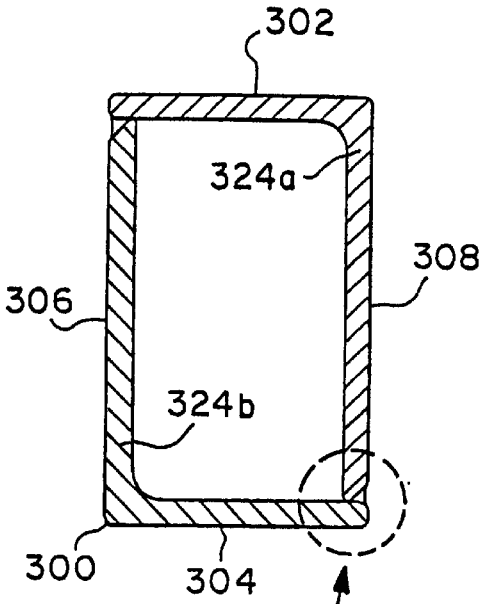
Fig. 5(c)
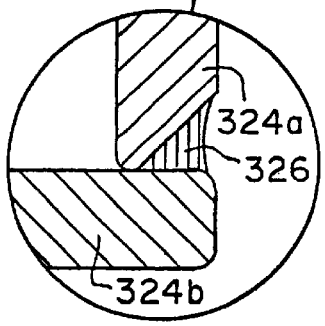
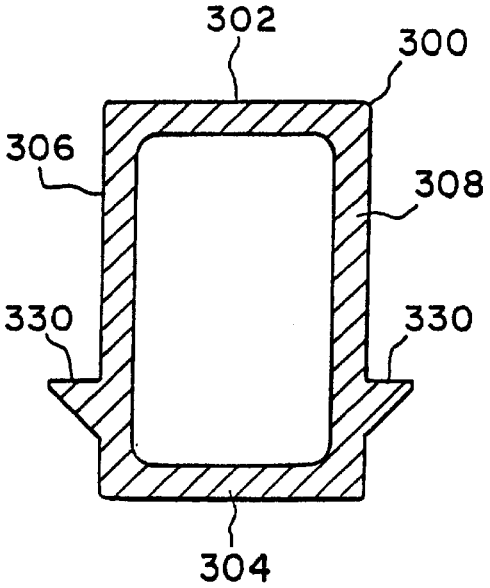
Fig. 5(d)
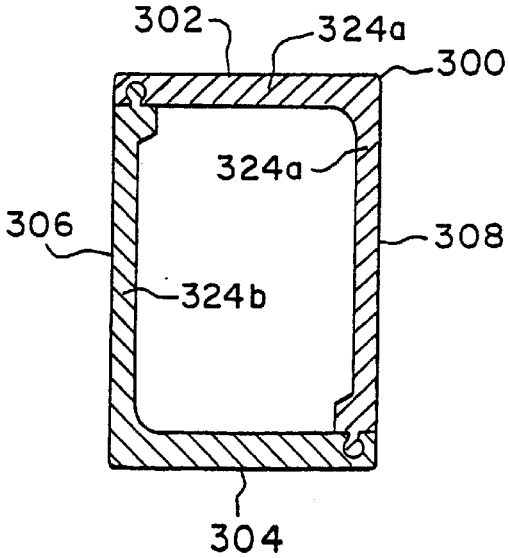
Fig. 5(e)

Fig. 8(a)
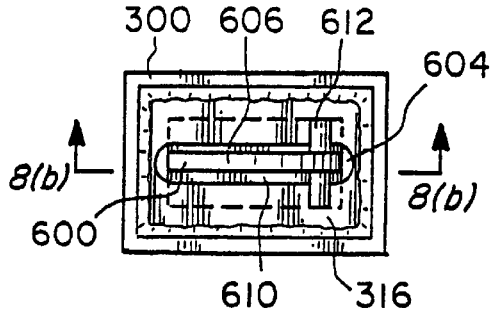
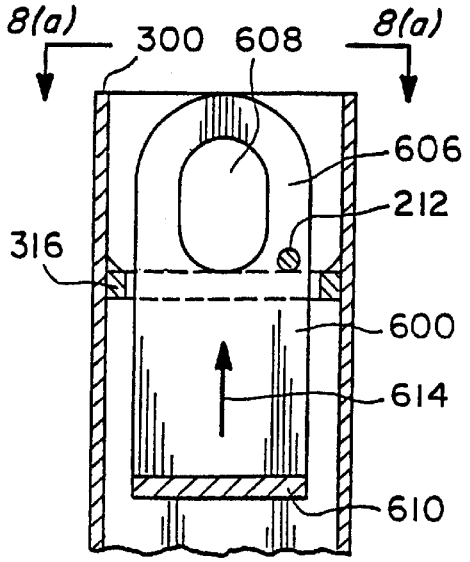
Fig. 8(b)
Fig. 8(c)
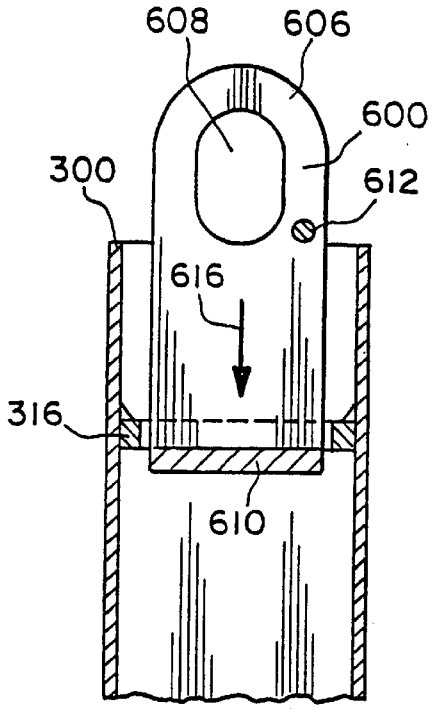
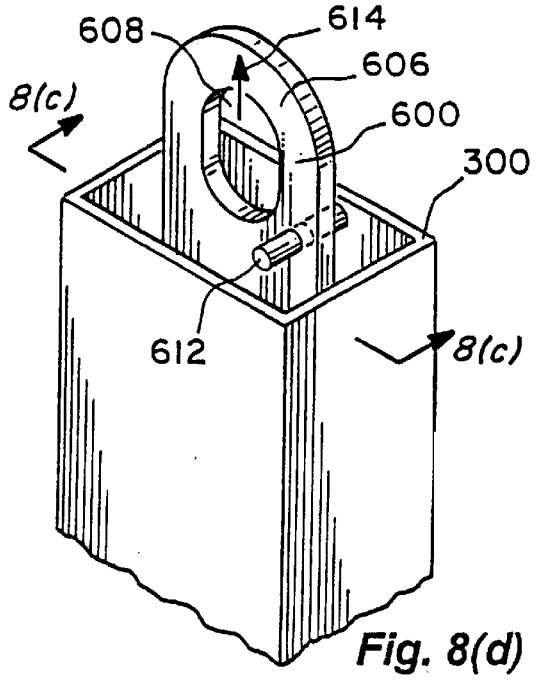
Fig. 8(d)
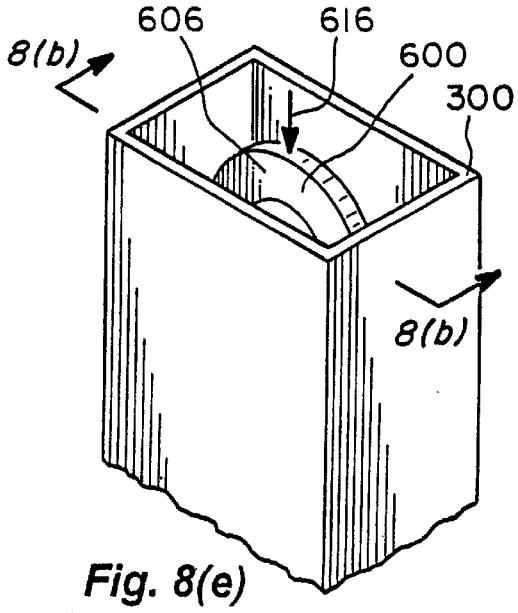
Fig. 8(e)

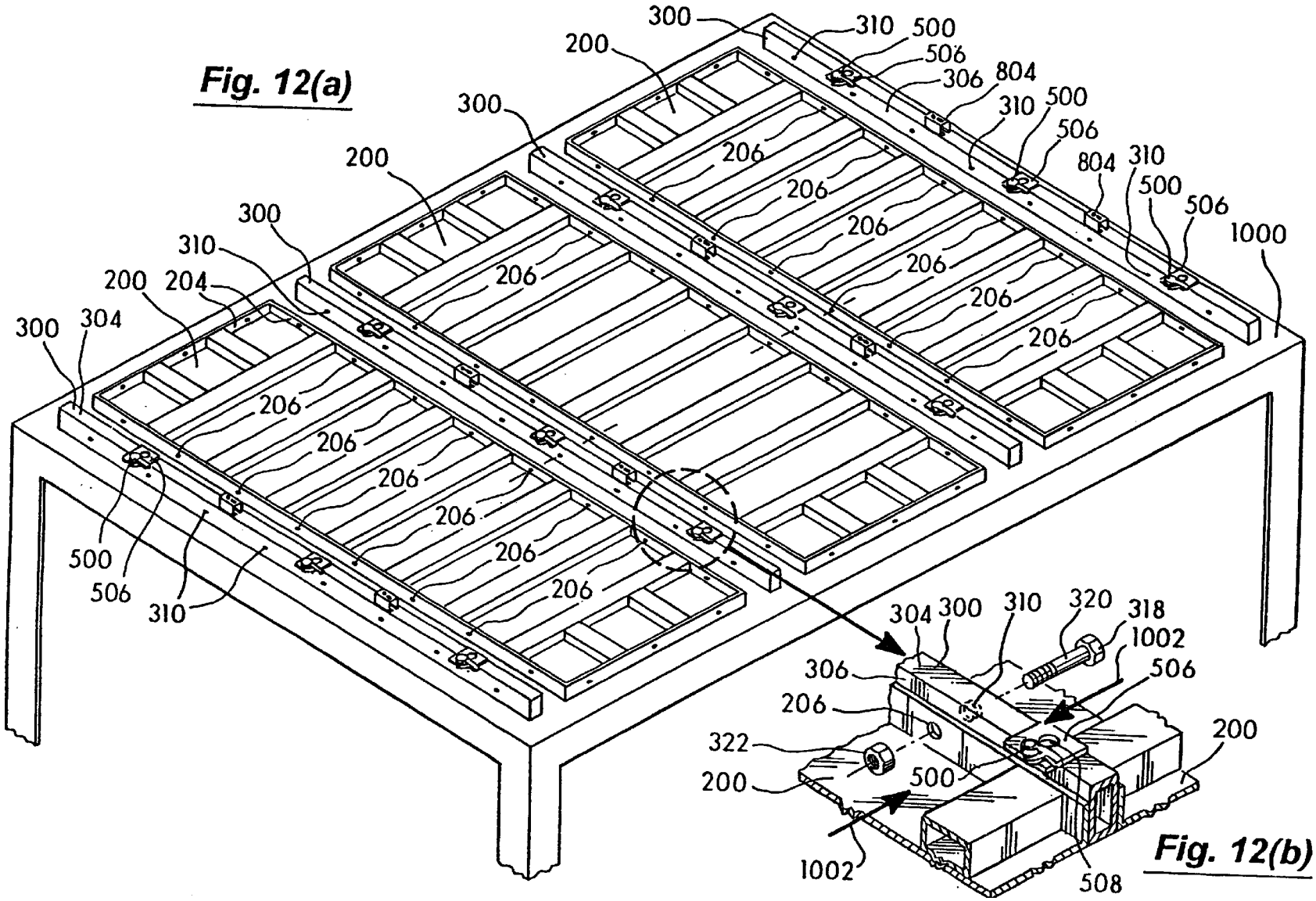
1000
506
500
310
804
506
500
804
310
306
506
500
310
300
200
300
200
300
310
204
200
304
300
206
206
206

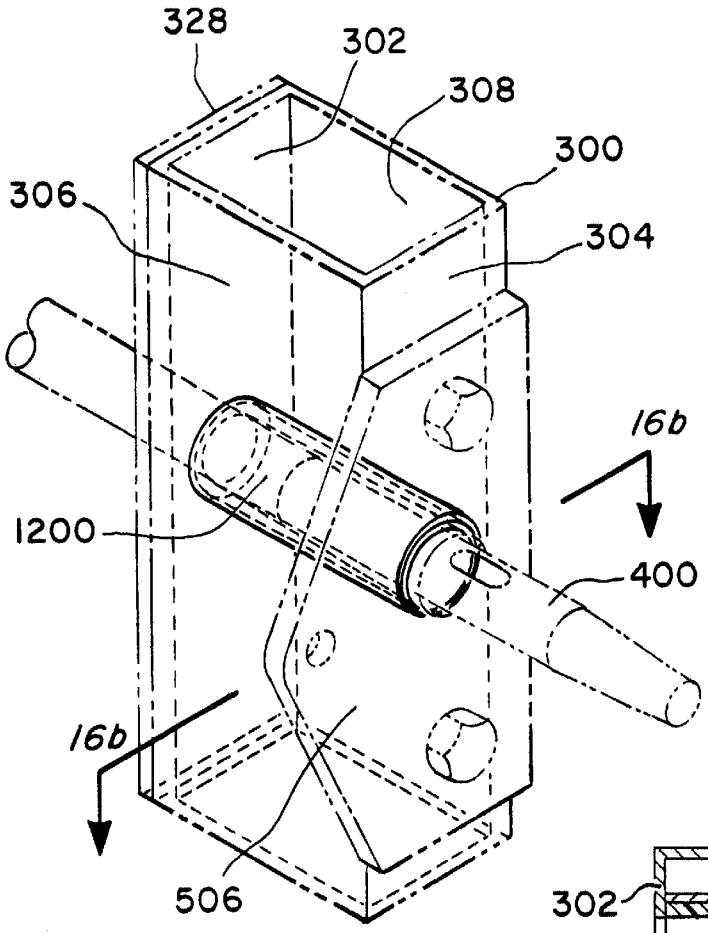
Fig. 15
Fig. 16a
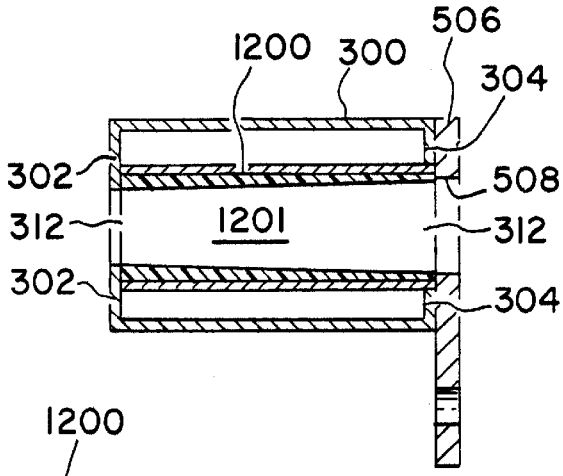
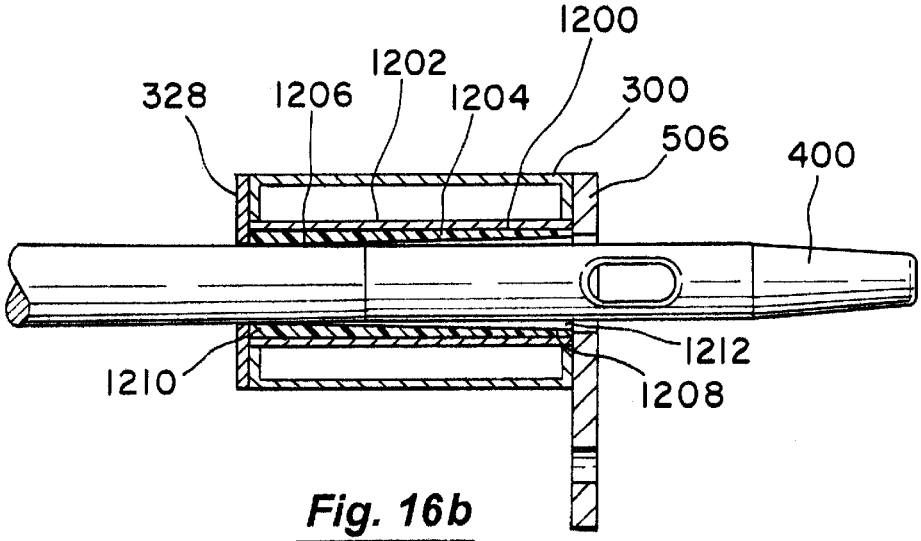
Fig. 16b

Fig. 23
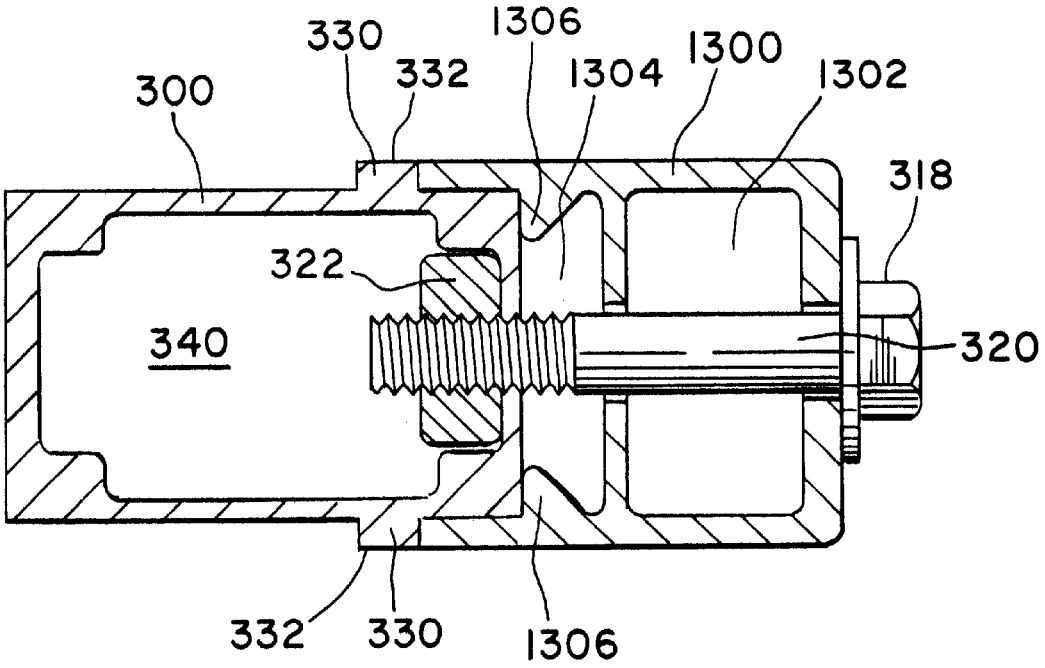
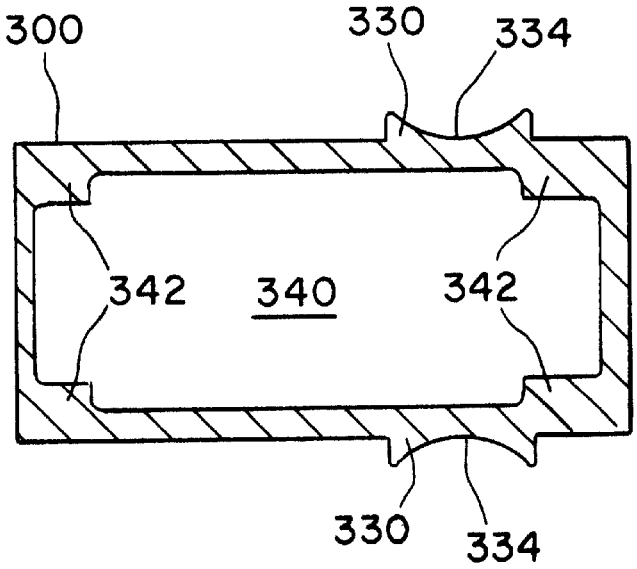
Fig. 18

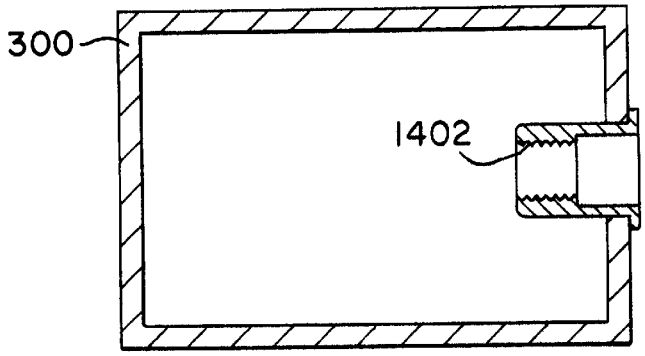
Fig. 30a
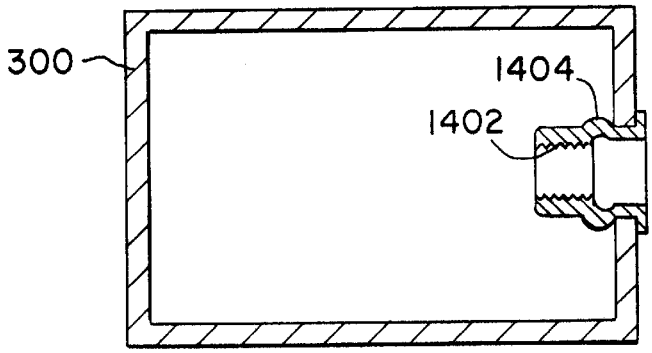
Fig. 30b
Fig. 31
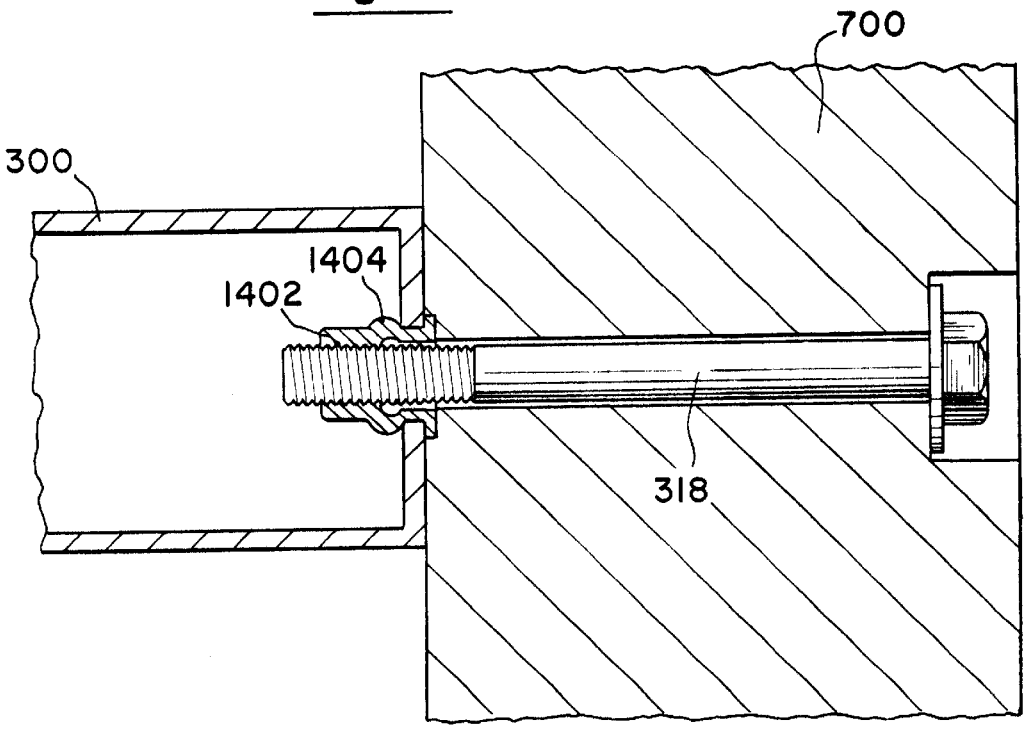

GANG FORM FOR USE WITH A CONCRETE FORM SYSTEM AND METHOD OF BUILDING A GANG FORM

RELATED APPLICATIONS

This application is a continuation in part of the applicants' co-pending U.S. patent application Ser. No. 09/484,486 filed on Jan. 18, 2000, which is a continuation in part of U.S. patent application Ser. No. 09/229,859, filed on Jan. 13, 1999, now U.S. Pat. No. 6,024,339, issued Feb. 15, 2000, entitled "Gang Form for Use with a Concrete Form System and Method of Building a Gang Form."

BACKGROUND OF THE INVENTION

1. Field of the Invention

The present invention relates, in general, to concrete form systems. More particularly, the present invention relates to a gang form having an improved insert for use with a concrete form system and a method of building the gang form.

2. Statement of the Problem

It is well-known in the construction industry to use concrete form systems to provide forms for pouring concrete in desired shapes, such as walls, stairs, sides of tanks, etc. Such concrete form systems often are made of a plurality of gang forms. A gang form conventionally is made of several form panels attached together at their edges until a surface of the desired dimensions is achieved. The form panels may be made of wood, metal, or other substances that provide the requisite flat surface and strength to bear the load placed on them by the poured concrete. However, most conventional form panels today are made of metal, preferably, aluminum, and are quite expensive. Therefore, it is advantageous to be able to reuse the form panels in a subsequent concrete building project.

To build concrete walls, the gang forms are generally positioned in a horizontally spaced relationship and interconnected with tie rods extending between the gang forms. After the concrete is poured and has hardened, the gang forms are removed.

The form panels from which gang forms are made are generally attached together at their edges with wedge bolts passing through holes in flanges surrounding each form panel. Wedge bolts are conventionally bolts with a slot in the body of the bolt. The bolt is inserted through the holes in the flanges, and a wedge is then inserted into the slot in the bolt and tapped into place. These wedges often loosen and fall out when the gang form is moved from place to place, causing the bolts to become loose and the gang form to lose structural integrity. Further, using such wedge bolts means that many small pieces must be available to the construction crew in order to replace lost wedges and bolts. In addition, one or more persons are needed to hold the form panels in place while yet another person inserts and wedges the wedge bolts. This causes difficulties during construction when it is preferable to have a minimum number of workers at a site.

The conventional form panels used for gang forms in concrete form systems generally include openings in the panels or in the flanges through which tie rods are received so that the gang forms can be interconnected to provide the concrete form system desired. The tie rods are generally attached to the form panels with a locking device, such as a cotter pin that passes through a hole in each end of the tie rod. Such a system for attaching the tie rods again has many small parts (the locking devices) which are easily misplaced and lost at a construction site. In order to position the tie rods, at least two persons must be present, one to insert and hold the tie rod in the opening and the other to attach the lock device to the tie rod. This system also limits the type of tie rod that can be used, as the tie rod is not directly attached to the form panel, which allows the form panel to slip along the tie rod. This is generally prevented by using tie rods with stops on the side of the form panel that faces the opposing form panel. It would be an advantage to be able to use other types of tie rods so that the same gang forms can be used in different types of construction projects.

The forces generated by the concrete as it is poured into the concrete form system are concentrated at the locations of the tie rods. These loads on the tie rods may cause the form panels to bend or break at those locations where the tie rods pass through the form panels, damaging the expensive form panels. In order to withstand these loading forces, the form panels are often reinforced at the locations of the tie rod openings. This necessarily adds to the cost and weight of the form panels. Often the gang forms must be additionally braced to stand up to the concrete loads. This means that more openings must be made in the gang forms in order to attach the braces.

When constructing a concrete wall, it is often advantageous to provide a scaffold on the gang form for the construction workers to stand on when they are directing the pouring of the concrete into the space between the gang forms or for other reasons. In order to attach a scaffold to a conventional form panel, the form panel must include either additional openings or additional brackets to permit the scaffold to be attached. Additional openings will tend to weaken the form panels and also provide places where concrete may leak through. Additional brackets add weight and expense to the form panels.

Thus, it would be advantageous in a concrete form system to provide a gang form that can be built by one person. It would also be advantageous to provide a gang form having a minimum of loose parts and a minimum of openings in the form panels. A gang form that can withstand the load forces placed on its tie rods by the concrete without additional bracing or strengthening of the form panels is needed. Further, it would be desirable to provide a gang form that enables additional bracing and scaffolding to be removably attached without weakening the form panel with additional holes, or adding material to the form panel, thus raising its expense. Finally, a gang form that is easily reused from one construction project to the next would significantly reduce the costs of labor and materials.

A search of the prior art in which gang forms are used in concrete form systems discovered the following patents:

| | | |
|---|---|---|
| Williams | 4,1551,975 | May 1, 1979 |
| Durbin | 4,192,481 | Mar. 11, 1980 |
| Durbin | 4,254,932 | Mar. 10, 1981 |
| Slonimsky et al. | 4,811,927 | Mar. 14, 1989 |
| Reiner | 2,332,166 | Oct. 19, 1943 |
| Gallis et al. | 4,473,209 | Sep. 25, 1984 |
| Johanson et al. | 4,211,385 | July 8, 1980 |

U.S. Pat. No. 4,151,975 issued to Williams set forth a panel junction assembly in which wall form panels with flanges along adjacent edges are joined by a channel strip traversed by tie systems securing opposite panel assemblies. Securing bolts traverse the adjacent flanges and the walls of the channel strip, and the tie systems are cross pinned to the channel strip.

U.S. Pat. Nos. 4,192,481 and 4,245,932 to Durbin disclose a concrete wall form including a support structure comprising a beam capable of functioning as a stringer with an associated tie rod locking system.

U.S. Pat. No. 4,811,927 to Slonimsky et al. teaches a tubular panel connecting member for use with tie rods and panels for a concrete forming structure. The tubular connecting member has two flanges having slots within to receive bolts. Aligned holes are provided in the tubular connecting member for passage of tie rods.

U.S. Pat. No. 2,332,166 to Reiner sets forth a form for making concrete walls that includes a series of panels that are separated by strips placed between the panels. The strips engage the undercut edges of the panels and are held in place with a complex system of devices attached to keyhole slots in the panels.

U.S. Pat. No. 4,473,209 to Gallis et al. discloses a prefabricated modular wallform unit in which the panels are designed to mate against one another and to define an aperture through which a tie rod passes. The panels have flanges that are designed to be attached together with a T-bolt.

U.S. Pat. No. 4,211,385 to Johanson et al. shows concrete forms each including a plurality of rectangular panels secured edgewise together by connectors. Each connector includes a pair of half sleeves through with tie rods extend.

None of the above-described patents provides a gang form that solves the problems discussed above.

3. Solution to the Problem

The present invention provides a reusable gang form for use with a concrete form system. The gang form includes at least two form panels with flanges. An improved insert, preferably usable with conventional form panels, is positioned between the flanges of at least two adjacent form panels and is attached to the flanges with attachment devices, preferably bolts and nuts, that provide a secure and firm attachment that is not likely to be loosened during the movement or use of the gang form.

The tie rods that interconnect the gang forms are preferably attached to the improved insert. The improved insert has at least one lock member rotatably attached to one side of the insert to secure a tie rod. Because the lock member is attached to the insert before the insert is positioned in the gang form, there is no need for the builder to find and attach a separate lock device to secure the tie rods. Thus, there is no risk that lock members will be lost or attached incorrectly, for example, in the wrong locations on the insert so that the tie rods are only attachable at one end, or attached insecurely. In a concrete form system having a plurality of gang forms of the present invention, one person can easily place the tie rods through the openings in the inserts and lock the tie rods in place.

The gang form of the present invention can be built by one person.

It is an object of the present invention to provide an improved insert that can be positioned between conventional form panels to provide a gang form for use in a concrete form system.

It is another object of the present invention to provide a gang form that has a minimum of unattached or loose parts.

It is an object of the present invention to provide an improved insert that has a lock member attached.

It is another object of the present invention to provide a method by which gang forms are built by one person.

It is yet another object of the present invention to provide a pick-up member that is retractable when not being used.

SUMMARY OF THE INVENTION

The present invention discloses a gang form for use with a concrete form system that has a plurality of gang forms interconnected with a plurality of tie rods. The gang form has at least two adjacent form panels, which have forming surfaces. When the gang forms are interconnected by the tie rods in the concrete form system, the forming surfaces of the form panels preferably face each other at a predetermined distance apart, and the concrete is poured between the gang forms.

Each of the form panels has flanges attached. The flanges extend in a direction away from and perpendicular to the forming surfaces. Flange openings are formed in the flanges at predetermined locations.

An improved insert is positioned between the two adjacent form panels. The improved insert preferably has a parallelogram shape having a first side, a second side opposite the first side, a third side, and a fourth side opposite the third side. The improved insert is positioned between the flanges of the form panels to align the first side with the forming surfaces of the form panels so that a smooth surface extends along the gang form. Thus, the concrete wall will have a smooth surface after the gang form is removed.

The positioning of the improved insert is such that the third side and the fourth side of the insert are placed adjacent to the flanges of the form panels. The third side and the fourth side have side openings at predetermined locations that align with the flange openings in the flanges when the insert is placed adjacent to the flanges.

Once the improved insert is positioned between the flanges so that the side openings are aligned with the flange openings, attachment devices are inserted through the flange openings and through the side openings to attached the insert to the flanges. The attachment devices are preferably reversible, so that the insert can be detached if desired.

As described above, the gang form of the present invention is preferably used in a concrete form system having a plurality of gang forms interconnected with a plurality of tie rods extending between oppositely disposed gang forms. In order to provide this system, the improved insert also has at least one tie rod opening in the first side and the second side of the insert at a predetermined location. On the second side of the insert (the side that faces away from the forming surface), a lock member is rotatably attached at a predetermined location adjacent to the tie rod opening in the second side. The lock member can be rotated between in unlocked position and a locked position. The lock member can be attached directly to the second side of the insert, or it can be attached to a plate that is then attached to the second side. The plate in such an embodiment preferably has a plate opening therein that is aligned with the tie rod opening in the second side when the plate is attached to the second side of the insert.

With the lock member in the unlocked position, one of the plurality of tie rods is extended through the tie rod openings in the first and second sides of the insert so that one end of the tie rod extends beyond the second side of the insert. The lock member is rotated from the unlocked position to the locked position in which it secures the tie rod to the insert and thus to the gang form, so that the gang form is interconnected with an opposing gang form to provide the concrete form system.

In a preferred embodiment, a claw is attached to the lock member. The tie rod preferably has a slot or a loop in its end. The slot is preferably configured to receive the claw. When the lock member is rotated to the locked position, the claw on the lock member extends through the slot in the tie rod.

In order to prevent the lock member from covering the plate opening and tie rod opening when the lock member is in its unlocked position, the plate also has a stop member attached at a location such that the lock member abuts the stop member when the lock member is rotated to the unlocked position.

Because the lock member attaches the tie rod to the insert, and thus to the gang form, different types of tie rods can be used in the present invention, and the builder is not limited to tie rods having, for example, stop members to prevent the gang forms from sliding along the tie rods.

The improved insert having the tie rods secured to it takes the majority of the load presented by the concrete as it is poured. This prevents the need to reinforce the form panels. The insert can be made stronger than the form panels at less expense in order to resist these loading forces. The insert also provides a bracing function for the form panels.

A method for building the gang form is also provided by the present invention. Preferably, the components of the gang form, that is, at least two form panels and an improved insert, are placed on a jig table that has a predetermined size corresponding to the desired size of the gang form to be built. The insert is positioned between the flanges of the form panels and attached to them with attachment devices that extend through the flange openings and the side openings in the insert. The form panels and insert are then lifted so that tie rods can be extended through the tie rod openings in the insert and secured to the insert with the lock members attached to the insert. The tie rods are then secured to additional gang forms to interconnect the gang form with the concrete form system. As will be evident to those skilled in the art, this method can be accomplished by a single person when necessary.

These and other advantages, features, and objects of the present invention will be more readily understood in view of the following detailed description and the drawings.

BRIEF DESCRIPTION OF THE DRAWINGS

FIGS. 5*a* through 5*e* are cross-sectional views of several embodiments of the improved insert of FIG. 4*a*.

FIG. 8*a* is a top elevational view of the recessed end of the improved insert.

FIGS. 8*b* and 8*c* are side elevational views of a pick-up member of the present invention.

FIGS. 8*d* and 8*e* are perspective views of the pick-up member of FIGS. 8*c* and 8*b*, respectively.

FIG. 12*a* is a perspective view illustrating the method of providing the gang form of the present invention.

FIG. 12*b* is a perspective view of the attachment of the insert to the form panels of FIG. 12*a*.

FIG. 15 is a perspective view of a sleeve inserted into the improved insert.

FIG. 16A is a cross-sectional view of a sleeve inserted into the improved insert, and FIG. 16B shows the sleeve with a lining and with a tie rod inserted through the sleeve.

FIG. 18 is a cross-sectional view of the aluminum improved insert of FIG. 17.

FIG. 23 is a cross-sectional view of the aluminum improved insert and splice box of FIG. 22.

FIGS. 30A and 30B are cross-sectional views of the improved insert and nutsert of FIG. 29.

FIG. 31 is a cross-sectional view showing the attachment of a waler to the improved insert using the nutsert and an attachment device.

DETAILED DESCRIPTION OF THE INVENTION

Figures 1, 2:
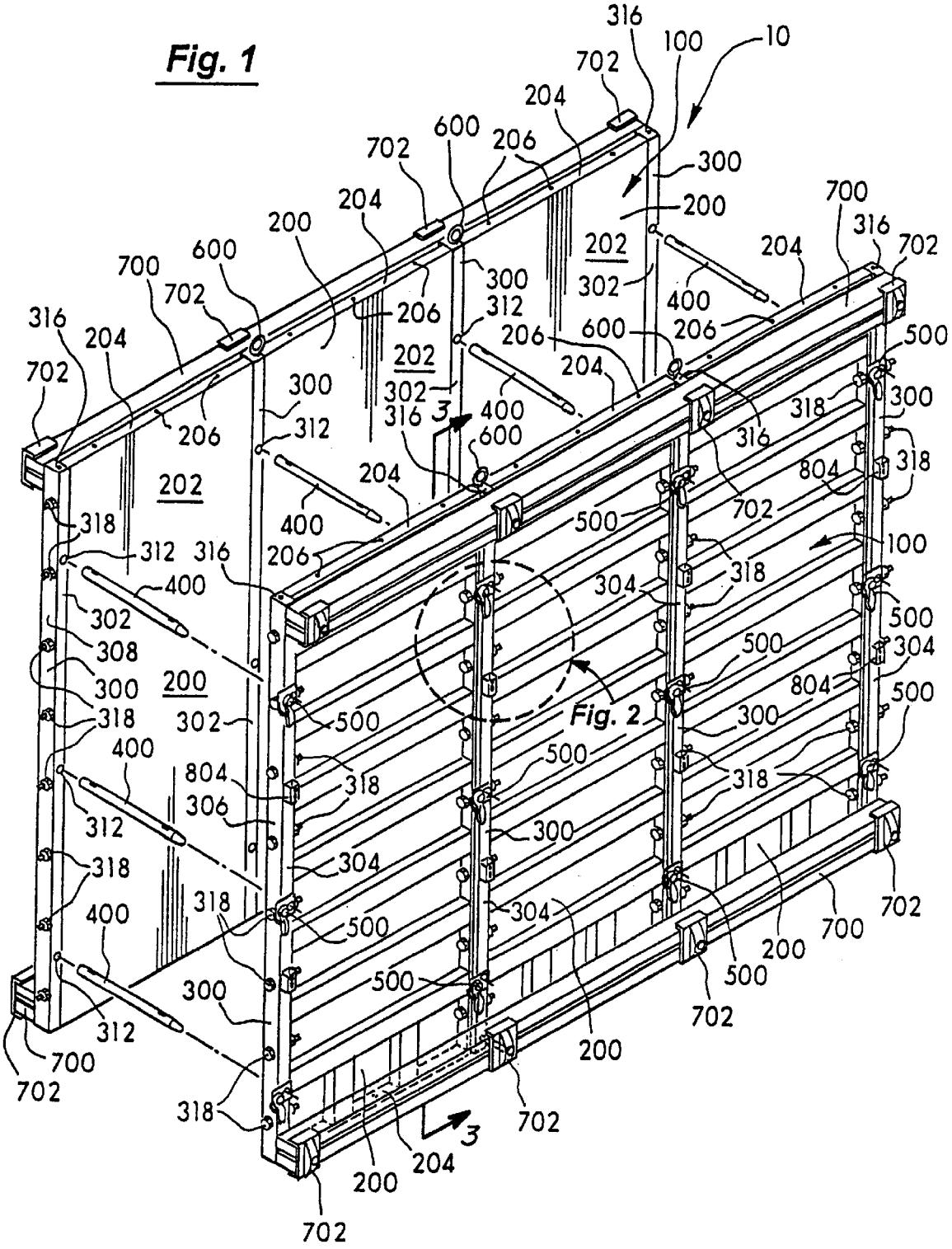
FIG. 1 illustrates an exploded perspective view of a concrete form system having gang forms with improved inserts of the present invention.
FIG. 2 shows a perspective view of a portion of the concrete form system of FIG. 1.
Figure 2:
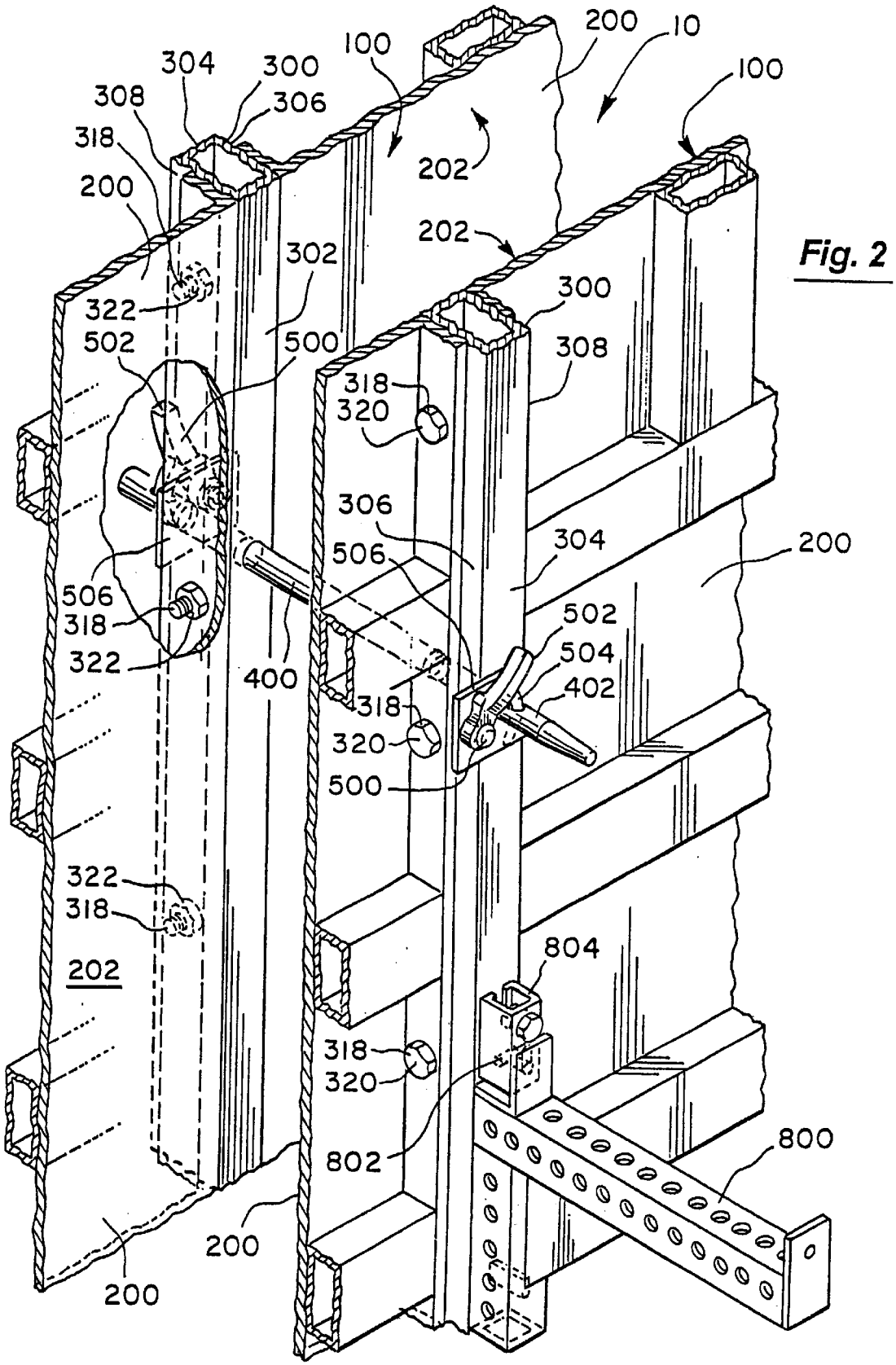

1. Overview. FIG. 1 illustrates in an exploded view a portion of a concrete form system 10 of the present invention, including a plurality of gang forms 100. The gang forms 100 are generally horizontally spaced at a predetermined distance to permit concrete to be poured therebetween in order to form a concrete wall. The gang forms 100 are placed on the ground 900 (see FIG. 3) or other surface onto which the concrete will be poured.

Each gang form 100 preferably comprises at least two adjacent form panels 200. The form panels 200 are preferably conventional form panels made of aluminum. The form panels 200 can have any desired dimensions and size, that is, they can be rectangular with a size approximately twice as tall as they are wide, as illustrated herein, or they can be square, etc., depending on the use to which the gang form 100 will be put.

The form panels 200 have flat forming surfaces 202 that are placed in a facing relationship in the concrete form system 10. Thus, when the concrete is poured into the form system 10, the concrete is adjacent to the forming surfaces 202 so that a smooth surface results when the gang forms 100 are removed. Each of the form panels 200 has flanges 204 attached to it, as can be more easily seen in FIGS. 2 and 12. In a preferred embodiment, the flanges 204 are attached to each edge of the form panel 200 as shown in FIG. 12. However, flanges 204 can be attached to one, two, or more edges of the form panel 200 as needed.

The flanges 204 preferably extend in a direction away from and perpendicular to the forming surfaces 202 of the form panels 200, as shown in FIGS. 2 and 12. Flange openings 206 are formed in the flanges 204 at predetermined locations, as can be seen more easily in FIG. 12.

Each gang form 100 preferably comprises an improved insert 300 positioned between the flanges 204 of the two adjacent form panels 200 to which the form panels 200 are attached, as described in greater detail below. The two adjacent form panels 200 when attached to the improved insert 300 provide a gang form 100 having a predetermined size. If larger gang forms 100 are desired, then additional form panels 200 and inserts 300 are attached until a gang form 100 of the desired size is provided. For example, FIG. 1 illustrates gang forms 100 having three adjacent form panels 200 with an insert 300 positioned between every two form panels 200.

After gang forms 100 of the desired size are built, they are interconnected by tie rods 400 to provide the concrete form system 10. The tie rods 400 are preferably secured to the inserts 300 with lock members 500 rotatably attached to the inserts 300 at predetermined locations as described more completely below. FIG. 2 illustrates a portion of the concrete form system 10 showing a tie rod 400 extending between the inserts 300 of opposing gang forms 100 and attached to each gang form 100 with the lock member 500 attached to the insert 300. The relative positions of the opposing gang forms 100 in the concrete form system 10 are also illustrated in FIG. 3.

Often the gang forms 100 are supported and braced with walers 700 extending horizontally across the width of the gang form 100 as shown in FIGS. 1 and 3. In a preferred embodiment, a double waler 700 having a first waler 700*a* and a second waler 700*b* is used. The double waler 700 is attached to the improved insert 300 at a predetermined location; in a preferred embodiment as shown in FIGS. 1 and 3, two double walers 700 are attached as shown in FIG. 3 and described in more detail below, one at top of the gang form 100 and one at the bottom of the gang form 100. Additional walers 700 can be attached to the gang form 100 if more support is needed, for example, if a wider or taller wall is to be made.

2. Improved Insert. The improved insert 300 of the present invention is shown in greater detail in FIGS. 4 and 5. The insert 300 generally has a parallelogram shape with four sides, a first side 302, a second side 304 opposing the first side 302, a third side 306, and a fourth side 308 opposing the third side 306. The first side 302 and the second side 304 are preferably substantially parallel to each other and at right angels to the third side 306 and the fourth side 308. In a preferred embodiment, the improved insert 300 is hollow, but in other embodiments the insert 300 can be of solid construction. The insert 300 is preferably made from cast or extruded aluminum or steel, but other materials are contemplated under the teachings of the present invention.

Figures 4A, 4B, 4C, 4D, 4E:
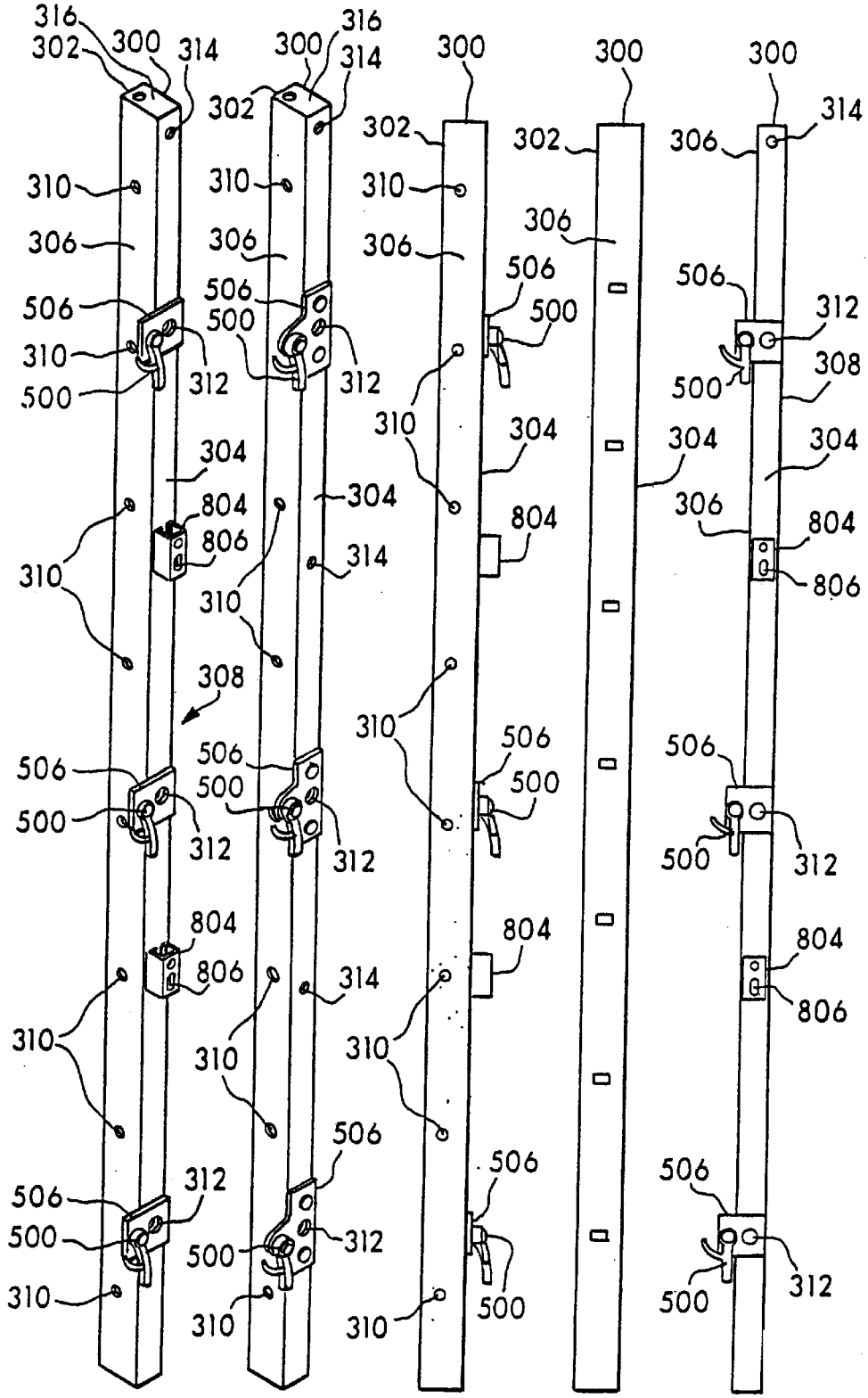
FIGS. 4*a* and 4*b* illustrate perspective views of two embodiments of the improved insert of the present invention.
FIG. 4*c* is a side elevational view of the improved insert illustrated in FIG. 4*a*.
FIG. 4*d* is a side elevational view of another embodiment of the improved insert.
FIG. 4*e* is a front elevational view of the improved insert of FIG. 4*a*.

Side openings 310 are formed in the third side 306 and the fourth side 308. The side openings 310 in the third side 306 are aligned with the side openings 310 in the fourth side 308. The side openings 310 are formed at predetermined locations to align with the flange openings 206 in the flanges 204 of the form panels 200. That is, in one type of conventional form panel 200, the flange openings 206 are located at certain predetermined locations, and the side openings 310 are placed to align with those flange openings 206, as shown in FIG. 4*c*. In another type of conventional form panel 200 from a different manufacturer, the flange openings 206 are located at other predetermined locations, and the inserts 300 to be used to build gang forms 100 with these form panels 200 have side openings 310 formed to align with these other predetermined locations, as shown in FIG. 4*d*. The side openings 310 can also be made in various shapes to better align with the various flange openings 206, as illustrated in FIG. 4*c*, in which the side openings 310 are circular, and in FIG. 4*d*, in which the side openings 310 are rectangular.

In a preferred embodiment shown in FIG. 5*a*, the insert 300 is a hollow rectangle made of a single extruded piece of metal. In a more preferred embodiment illustrated in FIGS. 5*b*, 5*c* and 5*e*, the insert 300 is made from two right-angle members 324*a*, 324*b*. This provides a significant cost savings over a single extruded hollow insert 300. The first right-angle member 324*a* comprises the first side 302 and the fourth side 308 of the insert 300, while the second right-angle member 324*b* comprises the second side 304 and the third side 306 of the insert 300. In a preferred embodiment shown in FIGS. 5*b* and 5*c*, the two right-angle members 324*a*, 324*b* are welded together with welds 326 to form the insert 300. In another preferred embodiment shown in FIG. 5*e*, the two right-angle members 324*a*, 324*b* have corresponding jigsaw extensions and slots that fit together to form the insert 300. It is evident that the two right-angle members 324*a*, 324*b* can be attached by any conventional method known to those skilled in the art that results in a secure attachment that will withstand the loading forces of the form panels 200 and the concrete.

When the insert 300 is positioned between the two adjacent form panels 200, preferably the first side 302 is aligned with the forming surfaces 202 of the form panels 200 to provide a smooth surface for the concrete facing, as illustrated in FIGS. 1 and 2. In order to make the concrete facing surface with a minimum of ridges, the corners of the insert 300 are preferably made square, as shown in FIG. 5*d*. In an alternative embodiment illustrated in FIG. 5*a*, an elongated plate 328 (shown only in cross section) is attached to the first side 302 of the improved insert 300 to provide square corners only where the insert 300 meets the edges of the form panels 200.

In another preferred embodiment shown in FIG. 5*d*, the insert 300 has flanges 330 attached to the third side 306 and the fourth side 308. The flanges 330 abut the ends of the flanges 204 of the form panels 200 (not shown) when the insert 300 is positioned between the form panels 200 to provide the gang form 100. This assists in providing the correct positioning of the improved inset 300 so that its first side 302 is aligned correctly with the forming surfaces 202 of the adjacent form panels 200. These flanges 330 also assist in aligning the side openings 310 in the third side 306 and the fourth side 308 with the flange openings 206 in the flanges 204 of the form panels 200.

After the improved insert 300 is positioned between the flanges 204 of the two adjacent form panels 200, attachment devices 318 are used to attach the insert 300 to the flanges 204. The attachment devices 318 are inserted through the flange openings 206 and then through the aligned side openings 310 in the third side 306 and the fourth side 308 of the insert 300 to firmly attach the improved insert 300 to the flanges 204. In a preferred embodiment best seen in FIG. 12*b*, the attachment device 318 is a bolt 320 and nut 322. The bolt 320 is inserted through the side openings 310 and the flange openings 206 and is firmly secured by the nut 322. Once the nut 322 is tightened, movement of the gang form 100 will not tend to loosen the attachment device 318, nor is it likely that the pieces 320, 322 of the attachment device 318 will need to be replaced, meaning that no additional attachment devices 318 need be present at the construction site. When the insert 300 is not being used in a gang form 100, the attachment devices 318 are preferably inserted through the side openings 310 and attached to the insert 300 until such time as the insert 300 is again used in a gang form 100. This also alleviates the need to have these parts separately available at a construction site. Other suitable attachment devices 318 will be evident to those skilled in the art and are contemplated under the teachings of the present invention.

In the preferred embodiment illustrated in FIGS. 1–3, the third 306 and fourth 308 sides of the improved insert 300 are longer than the flanges 204 that they abut, causing the second side 304 of the insert 300 to extend beyond the flanges 204. However, it is to be expressly understood that the third 306 and fourth 308 sides of the insert 300 can be of equal length with the flanges 204, causing the second side 304 of the insert to be aligned with the flanges 204 after the insert 300 is attached to the flanges 204.

The improved insert 300 preferably has at least one tie rod opening 312, as shown in FIG. 4, formed at a predetermined location in the first side 302 and the second side 304. The tie rod opening 312 in the first side 302 is aligned with the tie rod opening 312 in the second side 304. The number of tie rod openings 312 depends on the size of the gang form 100 and on the amount of load to be placed on the gang form 100 by the concrete. In a preferred embodiment illustrated in FIG. 4*e*, at least three tie rod openings 312 are formed in the insert 300, one near each end 316 of the insert 300 and one approximately midway.

In a preferred embodiment of the present invention, the improved insert 300 has at least one lock member 500 rotatably attached to the second side 304 of the insert 300 at a predetermined location. Preferably, the lock member 500 is attached adjacent to the tie rod opening 312, as shown in FIG. 4 and as better seen in FIG. 6*d*. The lock member 500 preferably comprises a handle 502 and a claw 504. The lock member 500 is rotatable between an unlocked position and a locked position, as described in more detail below.

Figure 6A:
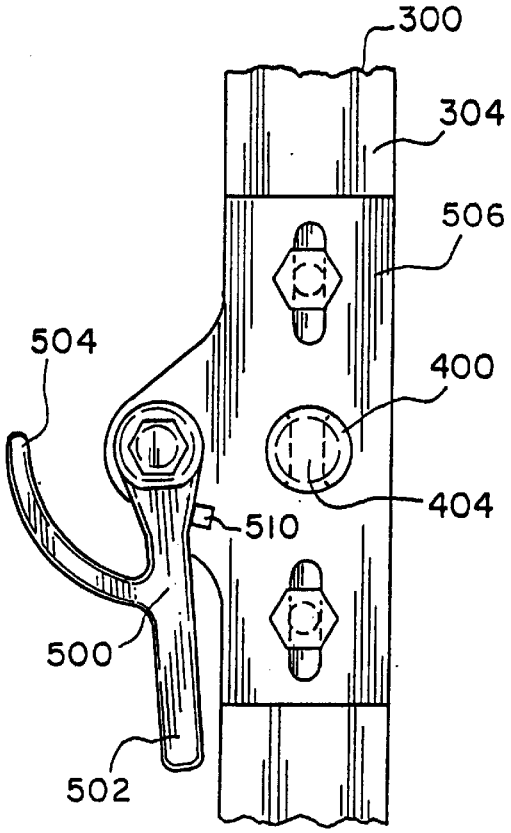
FIGS. 6*a* through 6*c* are front elevational views of the lock member and plate of the present invention.
Figure 6B:
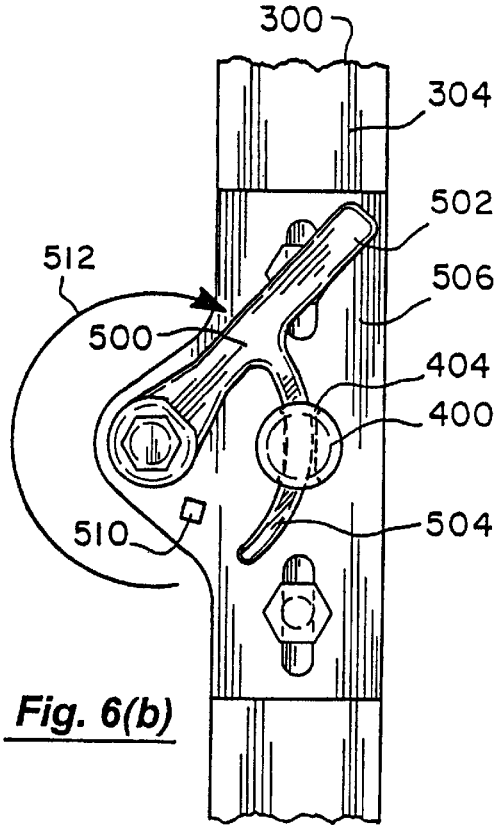
Figure 6C:
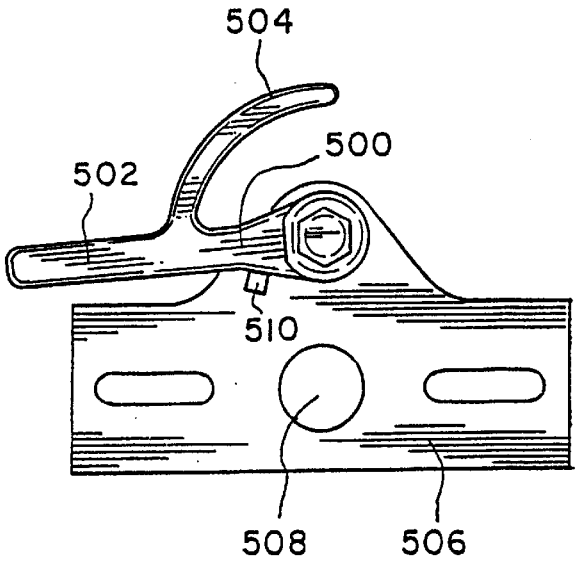
Figure 6D:
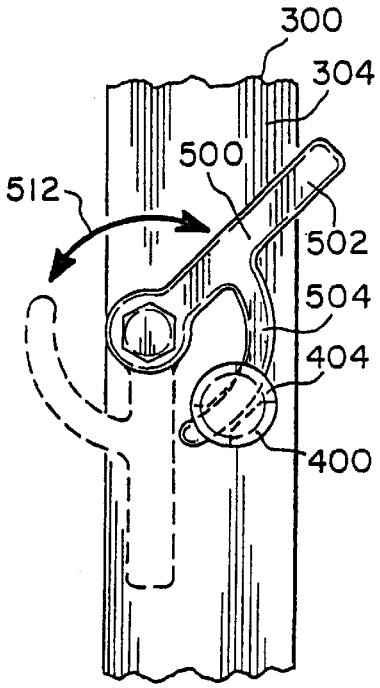
FIG. 6*d* is a front elevational view of the lock member attached directly to the second side of the improved insert.

The lock member 500 can be attached directly to the second side 304 of the insert 300, as shown in FIG. 6*d*. Alternatively, the lock member 500 is attached to a plate 506 that is then attached to the second side 304 of the improved insert 300, as shown in FIGS. 4 and 5*a*–5*c*. The plate 506 has a plate opening 508 formed therein that is preferably aligned with the tie rod opening 312 in the second side 304. The plate 506 can be used in either a vertical position, as shown in FIGS. 6*a* and 6*b*, or a horizontal position, as shown in FIG. 6*c*. Furthermore, the plate 506 can be of any shape that permits it to be attached to the second side 304 of the insert 300 and also permits the lock member 500 to be attached to the plate 506 adjacent to the tie rod opening 312. For example, a rectangular shape is shown in FIGS. 1, 2, and 4*a*, whereas another shape is illustrated in FIGS. 4*b* and 6. Such other shapes will be evident to those skilled in the art and the present invention is not meant to be limited by any particular descriptions herein. The plate 506, while providing a convenient attachment point for the lock member 500, also assists in spreading the load from the concrete over a wider area of the improved insert 300.

In a preferred embodiment, the plate 506 has a stop member 510 attached to the plate 506 at a predetermined location. The lock member 500 abuts the stop member 510 when the lock member 500 is in its unlocked position, as shown in FIGS. 6*a* and 6*c*. The stop member 510 thus prevents the lock member 500 from swinging over in front of the tie rod opening 312 and blocking the opening 312.

It is important to the present invention that the lock member 500 is attached to the improved insert 300 before the insert 300 is positioned between the two adjacent form panels 200. This assists in the securing of the tie rods 400 to the gang forms 100 and in aligning the tie rods 400 from one gang form 100 to the facing gang form 100 in a concrete form system 10. It also reduces the number of loose parts that must be present at the construction site. A further advantage of an attached lock member 500 is that it allows a single person to easily build a gang form 100, as described in more detail below.

Figure 13A:
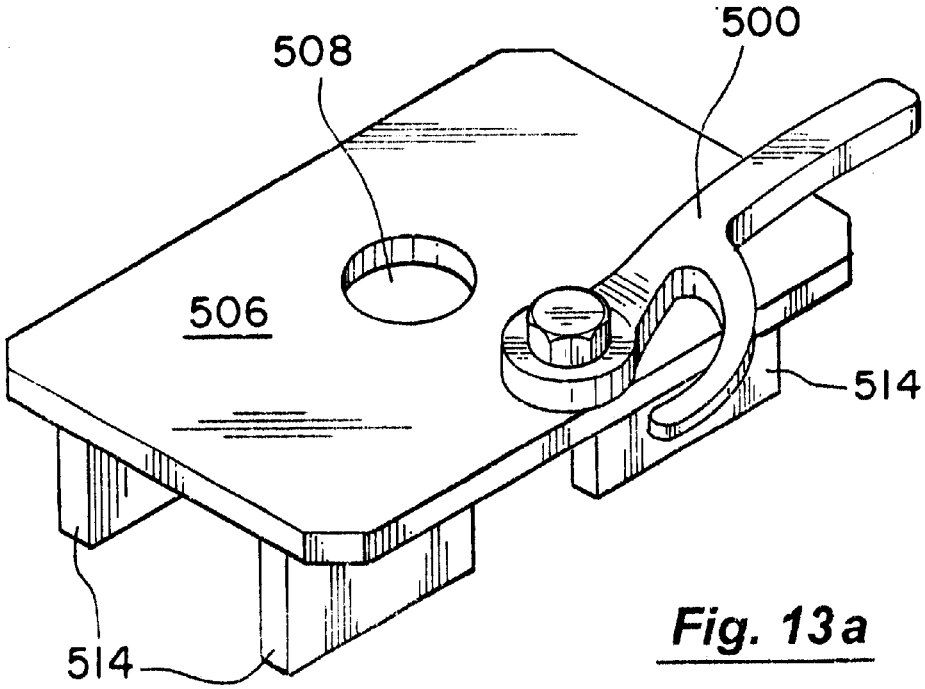
FIGS. 13*a* and 13*b* illustrate perspective views of a plate having legs.
Figure 13B:
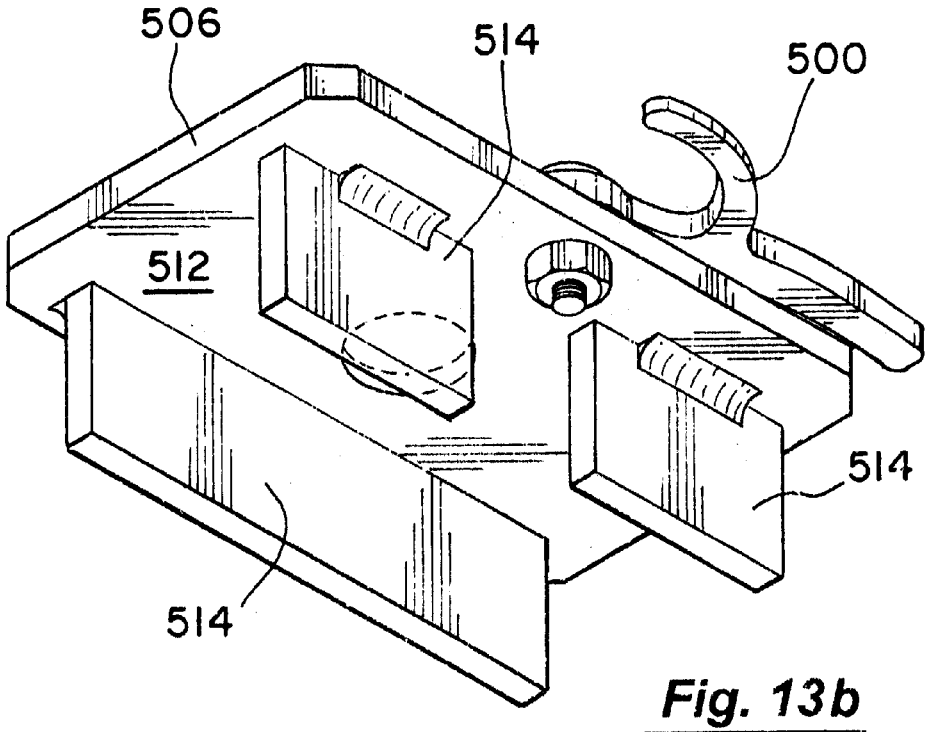

In a second preferred embodiment, shown in FIGS. 13*a* and 13*b*, the plate 506 has a rear side 512 adjacent to the second side 304 of the improved insert 300 when the plate 506 is attached to the improved insert 300 as described above. A plurality of flanges 514 are attached to the rear side 512 at predetermined locations. (Or, in another preferred embodiment, the plate 506 and flanges 514 are cast as a single piece by methods that will be known to those skilled in the art.) The plurality of flanges 514 abut the third side 306 and the fourth side 308 of the improved insert 300 when the plate 506 is attached to the second side 304 of the improved insert 300. The plurality of flanges 512 also abut the flanges 204 of the form panels 200 when the plate 506 is attached to the improved insert 300. The abutment of the two sets of flanges 514 and 204 assists in supporting the weight of the concrete when it is poured into the concrete form system 10.

Figures 3A, 3B:
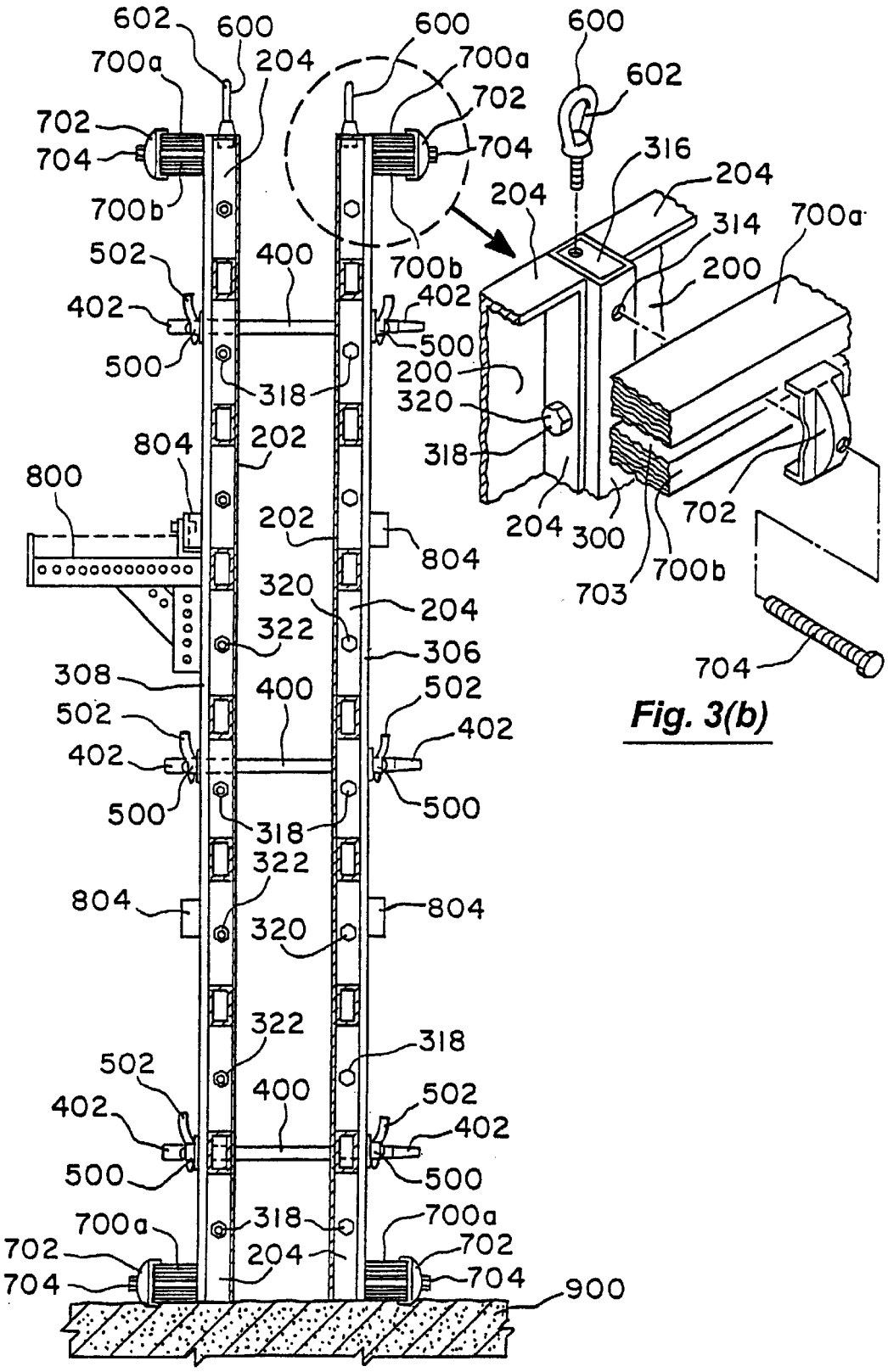
FIG. 3*a* is a cross-sectional view of the concrete form system of FIG. 1.
FIG. 3*b* is an exploded view of the attachment of a double waler to the concrete form system of FIG. 3*a*.
Figure 7:
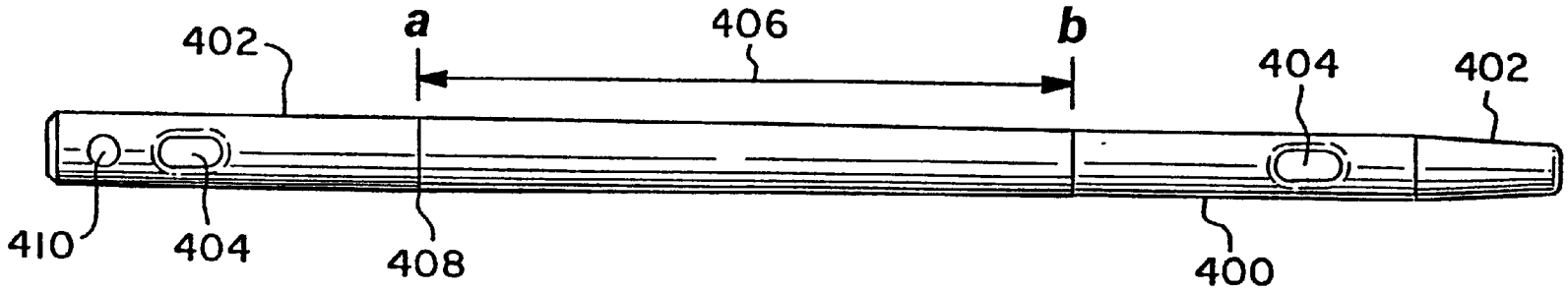
FIG. 7 is a side elevational view of a tie rod.

After the improved insert 300 is attached to the form panels 200 as described above, the tie rods 400 that interconnect the gang forms 100 in the concrete form system 10 are secured to the improved insert in the following manner. Each tie rod 400 preferably has a slot 404 in each end 402, as illustrated in FIG. 7. One of the plurality of tie rods 400 is inserted in the at least one tie rod opening 312 in the improved insert 300 so that one end 402 of the tie rod 400 extends through the tie rod opening 312, and the plate opening 508 if a plate 506 is present, beyond the second side 304 of the improved insert 300 as shown in FIG. 2. The slot 404 in the end 402 of the tie rod 400 is thus placed adjacent to the lock member 500 attached adjacent to the tie rod opening 312. The slot 404 is preferably configured to receive the claw 504 of the lock member 500 therethrough. The lock member 500 is then rotated 512 with the handle 502 to the locked position as shown in FIGS. 6*a* and 6*b* (and in FIG. 6*d*) so that the claw 504 extends through the slot 404 in the tie rod. This firmly secures the tie rod 400 to the improved insert 300. When the other end 402 of the tie rod 400 is similarly secured to the opposing gang form 100, this interconnects the gang form 100 with the concrete form system 10, as shown in FIGS. 2 and FIG. 3*a*.

The tie rod 400 of the preferred embodiment of the present invention is illustrated in FIG. 7. This is a conventional tie rod 400 that comes in a number of predetermined lengths which are chosen depending on the desired thickness of the concrete wall to be built. The tie rod 400, in addition to having a slot 404 in each end 402 with which to be secured to the insert 300 of the gang form 100, also has a hole 410 in one end that is used to hang the tie rod 400 on a peg (not shown) when the tie rod 400 is not in use in the gang form 100. In the preferred embodiment, the tie rod 400 is tapered 406 from a to b, with a slight step 408 occurring at position a. This taper 406 and step 408 enables the tie rod 400 to be removed from the concrete after the concrete has hardened.

It is to be expressly understood that other types of tierods 400 and lock members 500 can be used in the present invention as long as the lock member 500 is attached to the improved insert 300 and as long as the tie rod 400 can be firmly secured by the lock member 500. For example, in another preferred embodiment (not shown), the tie rod 400 has a center portion that is reversibly attached to two end portions such that the end portions can be removed from the hardened concrete, leaving behind the center portion to act as a support in the concrete wall. Other combinations of lock members 500 and tie rods 400 will be evident to those skilled in the art, and the present invention is not meant to be limited by any particular description herein.

In a preferred embodiment, the improved insert 300 has an end 316 attached to the first 302, second 304, third 306, and fourth 308 sides, as illustrated in FIG. 4*a*. A pick-up member 600 is preferably attached to the end 316 in order to enable the insert 300 and/or the gang form 100 to be lifted with, for example, a crane. In one preferred embodiment, the pick-up member 600 is a loop 602, as shown in FIGS. 1 and 3*a* and 3*b*. The loop 602 is preferably simply screwed into the end 316 of the improved insert 300, as shown in FIG. 3*b*.

In another preferred embodiment, illustrated in FIG. 8, the end 316 of the improved insert 300 is recessed. A slot 604 is formed in the recessed end 316. The pick-up member 600 comprises a blade 606 that extends through the slot 604. The blade 606 has an opening 608 at its top portion, and a plate 610 is attached to its bottom portion, as shown in FIG. 8. When the pick-up member 600 is not in use, the pick-up member 600 is retracted 616 by its own weight inside the insert 300, as shown in FIGS. 8*c* and 8*e*. A stop pin 612 abutting the end 316 prevents the blade 606 from falling down into the insert 300 when it is retracted. When it is desired to use the pick-up member 600 to lift the gang form 100 or insert 300, the blade is extended 614 above the improved insert 300 until the opening 608 is available, as shown in FIG. 8*d*. The plate 610 abuts the end 316 and prevents the blade 606 from being pulled out of the insert. The plate 610 also supports the insert 300 when it is lifted by the pick-up member 600.

It will be evident to those skilled in the art that other types of pick-up members 600 can be used in the present invention, and the present invention is not meant to be limited by any particular description found herein, but only by the claims.

Figures 11A, 11B:
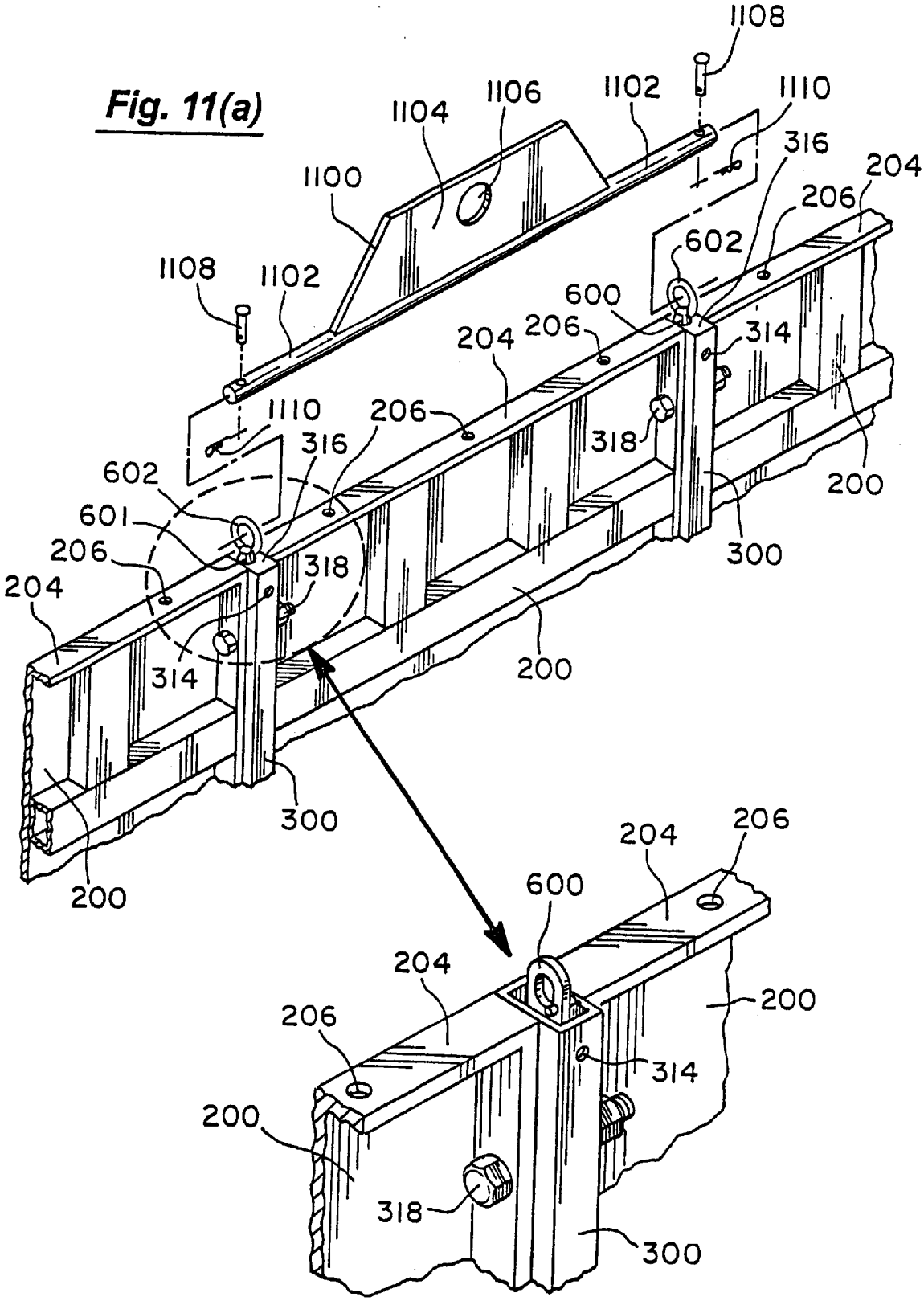
FIG. 11*a* is a perspective view of a pick-up device.
FIG. 11*b* is a perspective view of the pick-up member of FIG. 8 used with the pick-up device of FIG. 11*a*.

A crane or other mechanical device can be used to lift the gang form 100 by being attached to the pick-up members 600. In another preferred embodiment shown in FIG. 11, a pick-up device 1100 is first attached to the pick-up members 600, either the loop 602 shown in FIG. 11*a* or the blade 606 as shown in FIG. 11*b*, so that the crane need only be attached at one location rather than several. The pick-up device 1100 preferably comprises a rod portion 1102 and a wing portion 1104. The ends of the rod portion 1102 are inserted through adjacent pick-up members 600 as shown in FIG. 11*a* and attached securely with attachment devices 1108, such as bolts, that are secured with cotter pins 1110. Other types of attachment devices 1108 will be readily apparent to those skilled in the art and are contemplated under the teachings of the present invention. After the pick-up device 1100 is attached to the pick-up members 600, a crane or other device is attached to the wing 1104, for example, by being attached to the opening 1106 in the wing, and the gang form 100 is lifted by the crane. If desired, the pick-up device 1100 can remain attached to the gang form 100 when not in use.

In a preferred embodiment, the improved insert 300 has at least one bracket hole 314 formed in its second side 304. The bracket hole 314 is placed at a location other than that of the tie rod openings 312. The bracket hole 314 is preferably used so that a scaffold bracket 800 can be attached when a scaffold is desired to be used with the gang form 100. The scaffold bracket 800 is held on the insert 300 in the manner illustrated in FIGS. 9*b* and 9*c*. That is, the scaffold bracket 800 preferably has a pin 802 attached to the scaffold bracket 800. In the preferred embodiment, the pin 802 is J shaped. The pin 802 is inserted 808 into the bracket hole 314 as shown in FIG. 9*b*, and then the scaffold bracket 800 is lowered in the direction shown by arrow 810 in FIGS. 9*b* and 9*c* until the scaffold bracket 800 abuts the second side 304 of the improved insert 300. Once two or more scaffold brackets 800 are thus held on the insert 300, a platform can be laid across the scaffold brackets 800 to make a scaffold, as shown in FIG. 3.

Figure 9A:
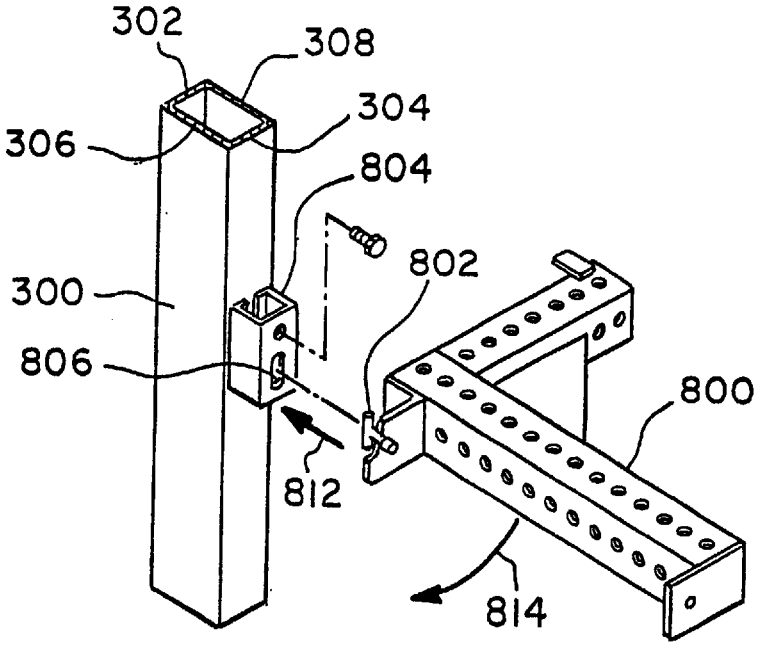
FIG. 9*a* is a perspective view of a bracket holder and scaffold bracket of the present invention.
Figure 9B:
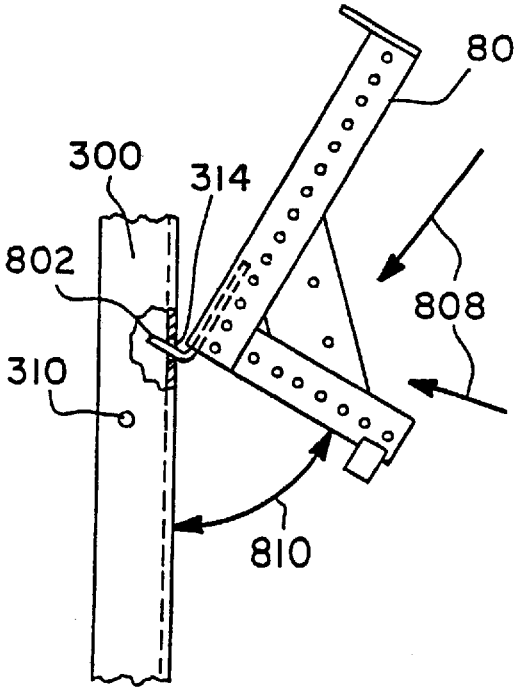
FIGS. 9*b* and 9*c* are side elevational views of another embodiment of the scaffold bracket illustrating the attachment of the scaffold bracket to the improved insert.
Figure 9C:
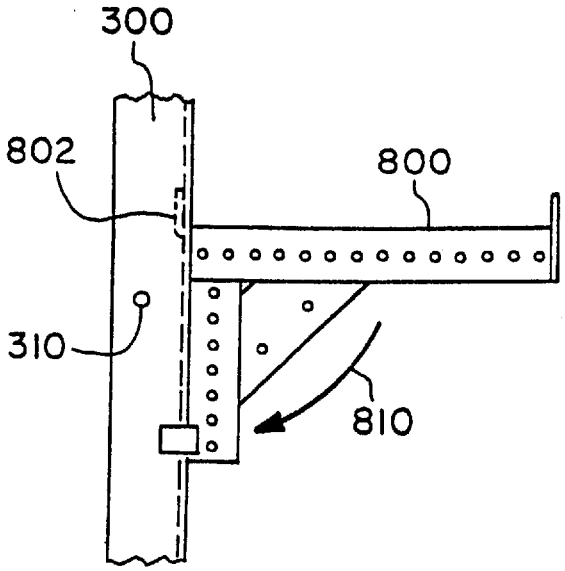

In another preferred embodiment illustrated in FIG. 9*a*, at least one bracket holder 804 having a slot 806 is attached to the second side 304 of the improved insert 300, again at a location away from the tie rod openings 312. In this embodiment, the pin 802 attached to the scaffold bracket 800 is T shaped. In order to hold the scaffold bracket 800 on the bracket holder 804, the scaffold bracket 800 is rotated to enable the t-shaped pin 802 to fit into the slot 806 on the bracket holder 804, as shown by arrow 812 in FIG. 9*a*. After the insertion 812 of the pin 802 into the slot 806, the scaffold bracket 800 is rotated in the direction indicated by arrow 814 until the scaffold bracket 800 abuts the second side 304 of the insert 300.

Figure 14:
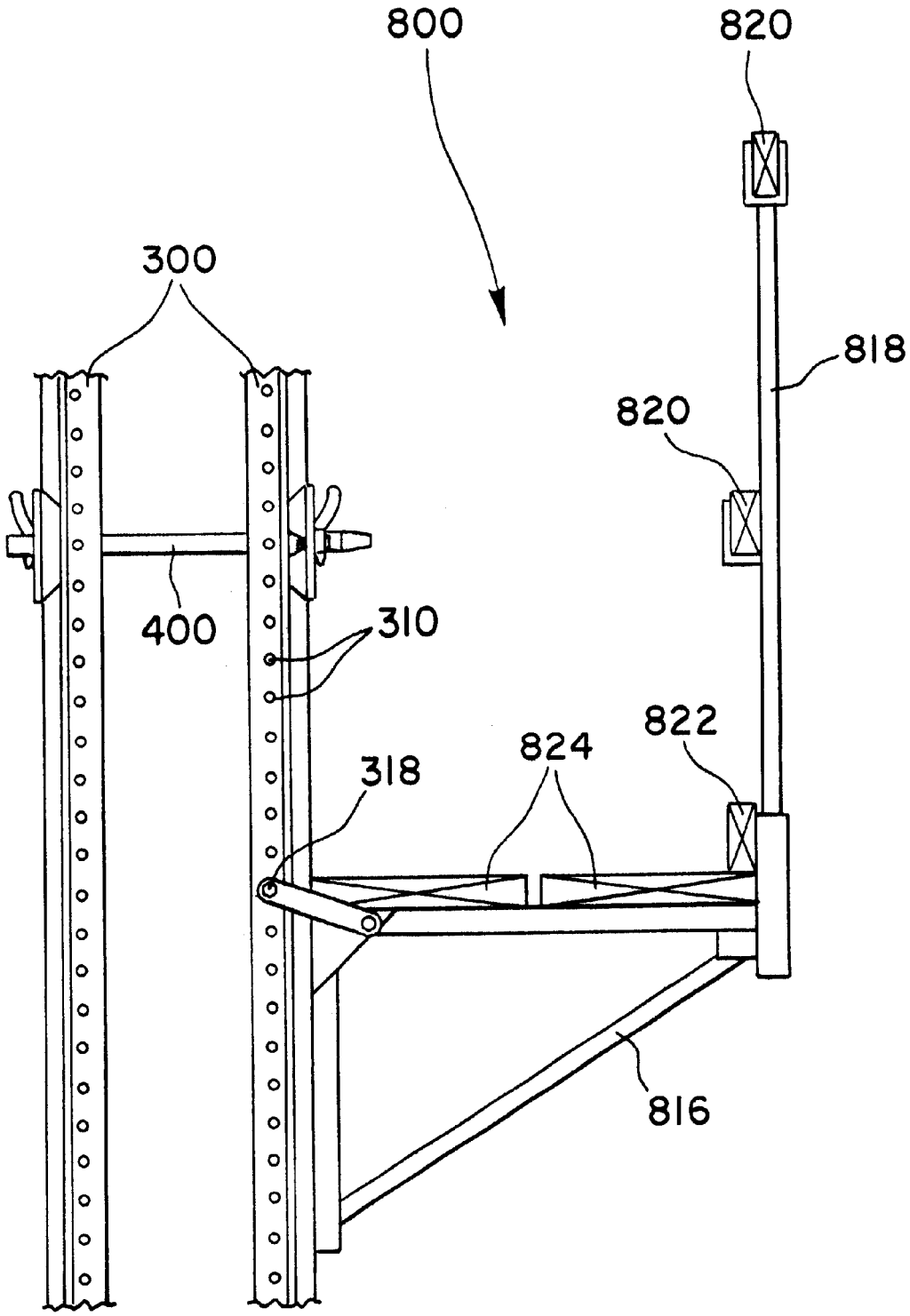
FIG. 14 is a side elevational view of a scaffold bracket and scaffold attached to the improved insert.

In another preferred embodiment, another embodiment of a scaffold bracket 816 is attached to the improved insert 300 in the manner illustrated in FIG. 14. The scaffold bracket 816 is attached to one of the side openings 310 in the third side 306 and the fourth side 308 of the improved insert 300 by using an attachment device 318, as shown in FIG. 14. The scaffold bracket 816 comprises a rail post 818 that holds a plurality of rails 820 and a toe plate 822. Once two or more scaffold brackets 816 are thus attached to the improved insert 300, a double platform 824 can be laid across the scaffold brackets 816 to make a scaffold, as shown in FIG. 14. Such a scaffold 816 can be attached to any portion of the gang form 100 but is preferably attached to the upper portion of the gang form 100 to improve the safety of workers who may be climbing on the concrete form system 10.

The bracket hole 314 also can be used to attach a double waler 700 to the insert 300 and thus to the gang form 100. In this preferred embodiment, two walers 700*a*, 700*b* are positioned within a waler bracket 702 as seen in FIG. 3*b* so that a gap 703 remains between the two walers 700*a*, 700*b*. A waler bolt 704 is then inserted through the waler bracket 702 and into the gap 703 between the walers 700*a*, 700*b* and is threaded into the bracket hole 314, as shown in FIG. 3*b*. Thus, a double waler 700 is held securely and reversibly on the gang form 100.

Figure 10:
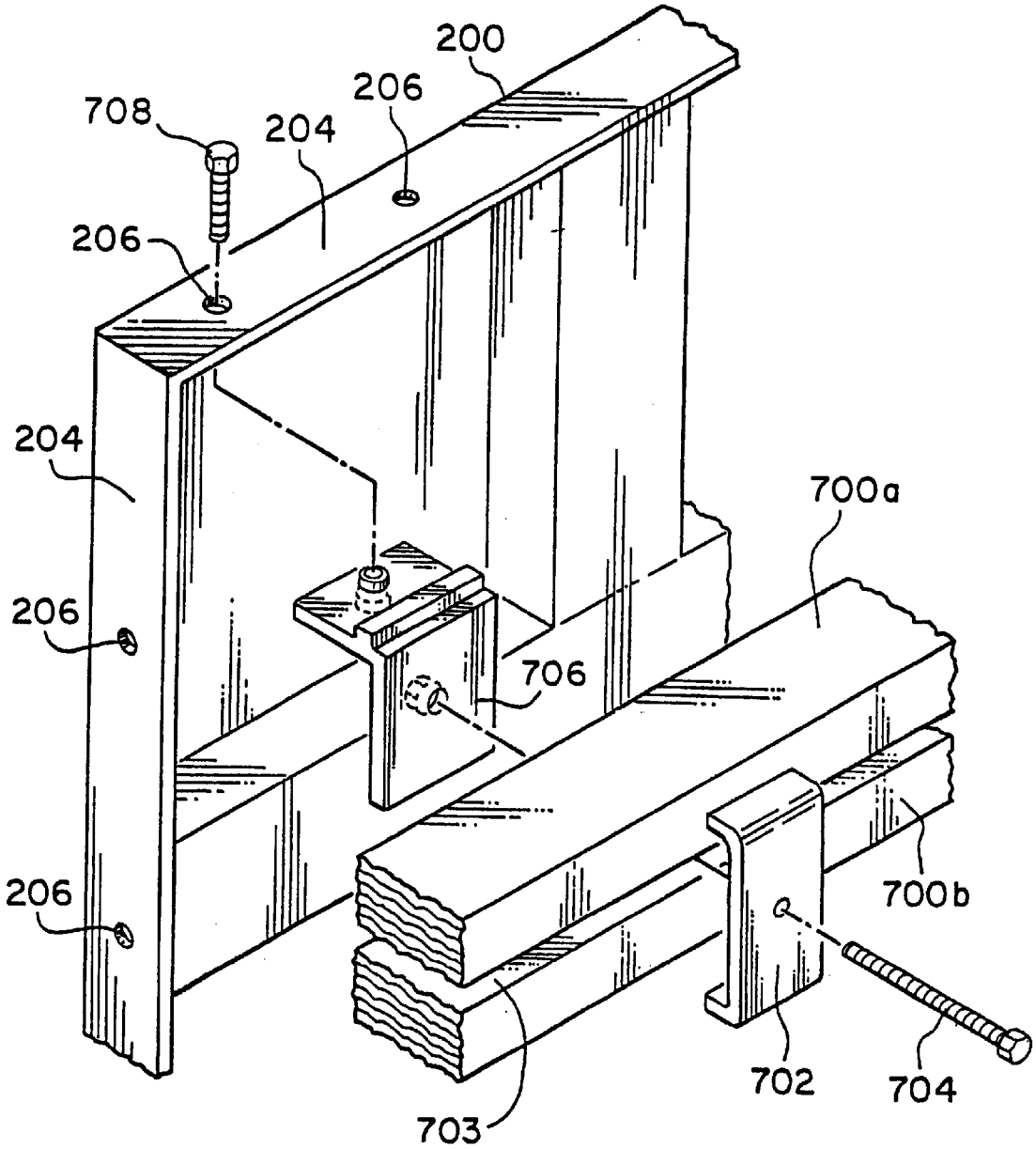
FIG. 10 is an exploded perspective view of the attachment of a double waler to an extension bracket.

In many instances, the end of the gang form 100 does not have an improved insert 300 attached, as illustrated in FIG. 10, for example, when the gang form 100 is to be used at a corner of the concrete form system. At these positions, an extension bracket 706 is attached to the flange 204 at the end of the form panel 200 with a bolt 708 to provide an attachment point for the waler bolt 704 that is at the same position with reference to the insert 300 as the other waler 700 attachment positions. In another preferred embodiment of the present invention, the improved insert 300 is formed of aluminum, as shown in FIGS. 17 through 23. The use of aluminum for the improved insert 300 provides several advantages to the present invention. Aluminum is stronger than steel, so use of an aluminum improved insert 300 increases the safety factor of a gang form 100. For example, a steel insert 300 can bear a load up to 8000 pounds. An aluminum insert 300 can bear a load in excess of 10,000 pounds. The weight of aluminum is less than that of steel, making it easier to maneuver the insert 300 in building the gang form 100 and resulting in a lighter gang form 100. Aluminum is easier to shape than steel, therefore it is less expensive to make a desired shape. For example, in an embodiment of the invention described above, in which the improved insert 300 is made of steel, it is difficult and not cost-effective to provide a steel insert without rounded corners. In this preferred embodiment, improved inserts 300 made of aluminum can be extruded so that the first side 302 adjacent to the concrete in the concrete form system 10 is square on each corner 302*a* and 302*b*. This removes the necessity to use an elongated plate 328 covering the first side 302 of the improved insert 300 to provide a flat surface for the concrete, which is necessary for use with an improved insert 300 made of steel. This reduces the expenses involved, such as labor time, in providing, plugging, welding, and grinding the flat plate 328. Finally, it is easier to punch openings in the aluminum insert 300, again providing significant savings in labor time.

Figure 17:
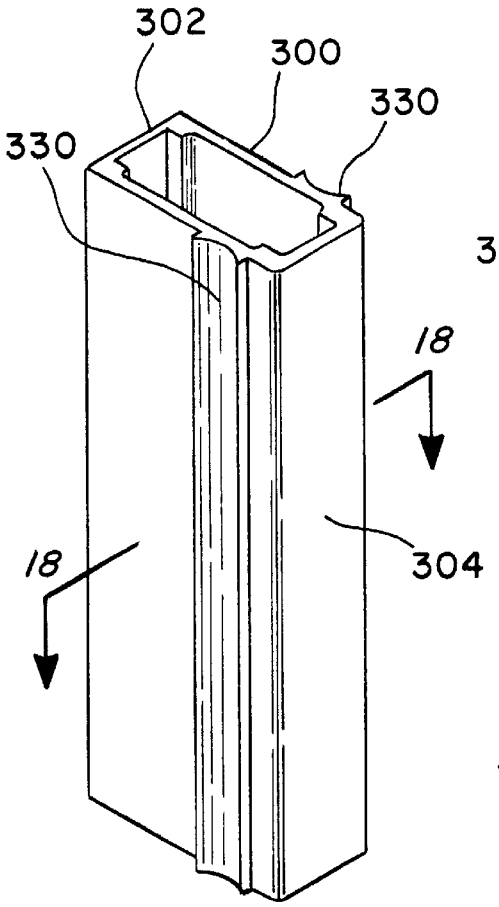
FIG. 17 is a partial perspective view of an aluminum improved insert.
Figure 22:
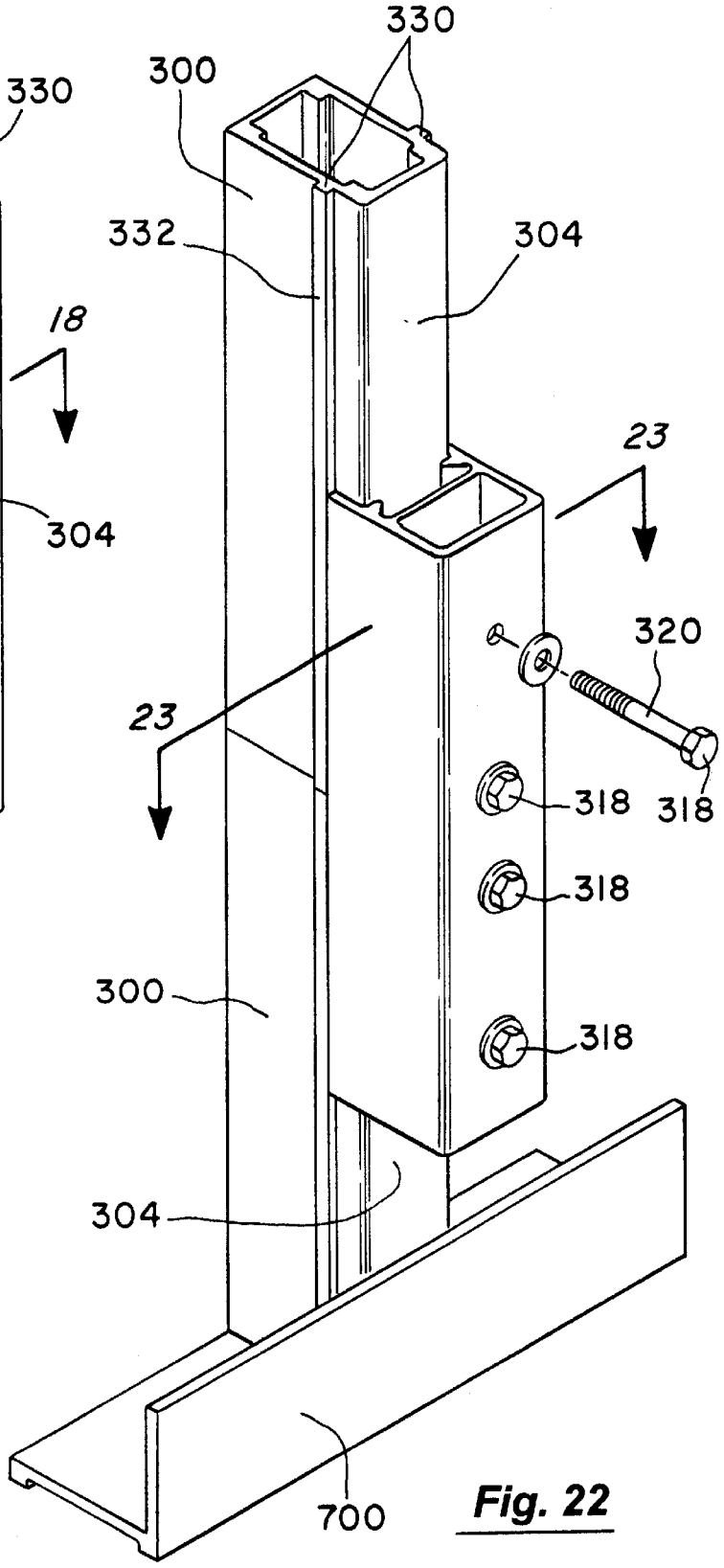
FIG. 22 is a perspective view of two aluminum improved inserts being joined with a splice box.

The aluminum improved insert 300 is shown in FIGS. 17 and 18. Its shape is generally similar to the shape of the prior improved insert 300 in that it is preferably rectangular, and has a first side 302, a second side 304, a third side 306, and a fourth side 308. It is used in the gang form system 100 in a similar way to the improved insert 300 described previously. The aluminum improved insert 300 also has a first flange 330 extending along the third side 306 and a second flange 330 extending along the fourth side 308. The flanges 330 may have either a flat face 332, as illustrated in FIGS. 22 and 23, or a concave face 334, as illustrated in FIGS. 17 and 18. The concave face 334 is used when it is desired to make a lighter and less expensive insert 300, since a portion of the aluminum is removed as compared to flanges 330 having flat faces 332. The flanges 330 are placed so that they abut the flanges 204 of the form panels 200 when the improved insert 300 is attached to the form panels 200, so that the pressure of the concrete poured into the concrete forming system 10 is supported along the entire length of the improved insert 300, as discussed above for the prior improved insert 300.

Figure 24:
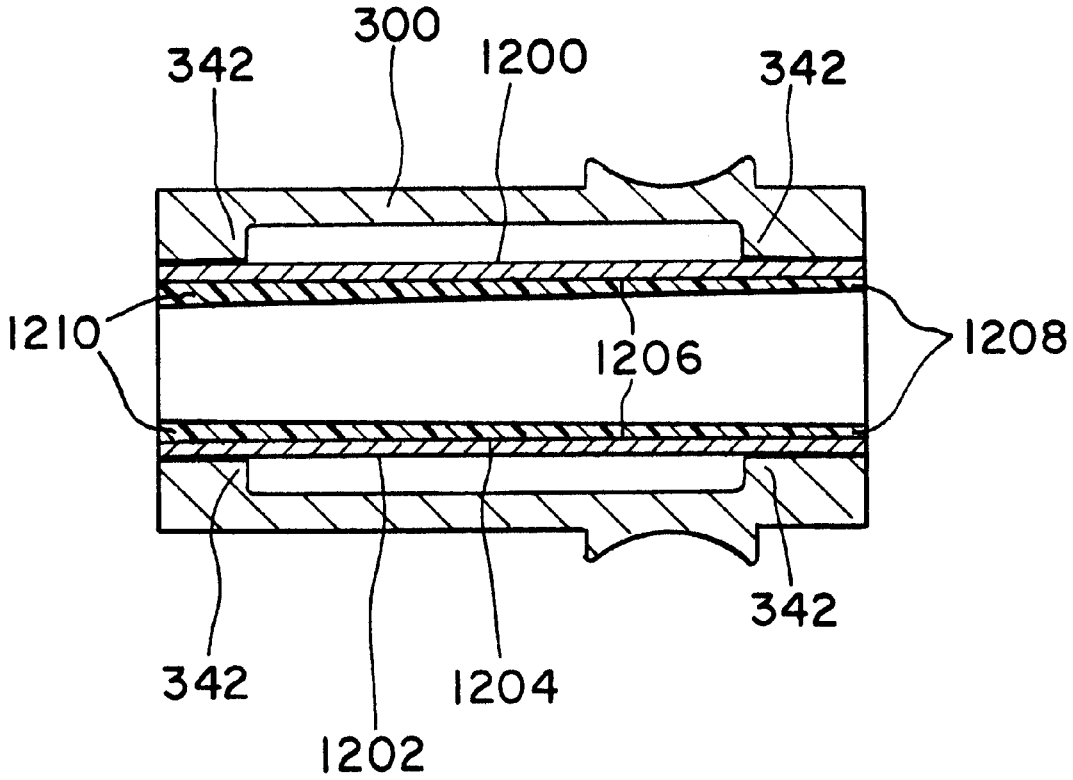
FIG. 24 is a cross-sectional view of an aluminum improved insert with a sleeve inserted through the tie rod openings.

As shown in FIG. 18, the aluminum improved insert 300 has an interior 340 with four corners where the four sides 302, 304, 306, 308 meet. Projections 342 extend from each corner into the interior 340. The projections 342 provide additional strength and support to the aluminum improved insert 300 when it is used in a gang form 100 so that the aluminum inserts 300 support the weight of the concrete. The projections 342 also act to support the sleeve 1200 as shown in FIG. 24. This is an important advantage because the projections 342 prevent any up and down or side to side motion of the sleeve 1200, which is held securely in place.

The aluminum insert 300 can be used in a gang form 100 in the same manner as the previously described improved insert 300. However, when using the aluminum insert 300 with a gang form 100, one can use a metal waler 700 rather than wooden walers 700 as shown previously above. With the metal waler 700, as few as two walers 700 can be used to support the gang form 100. The metal walers 700 are preferably attached at the ends of the aluminum insert 300 as shown in FIGS. 19, 20, 21, and 22.

Figure 20:
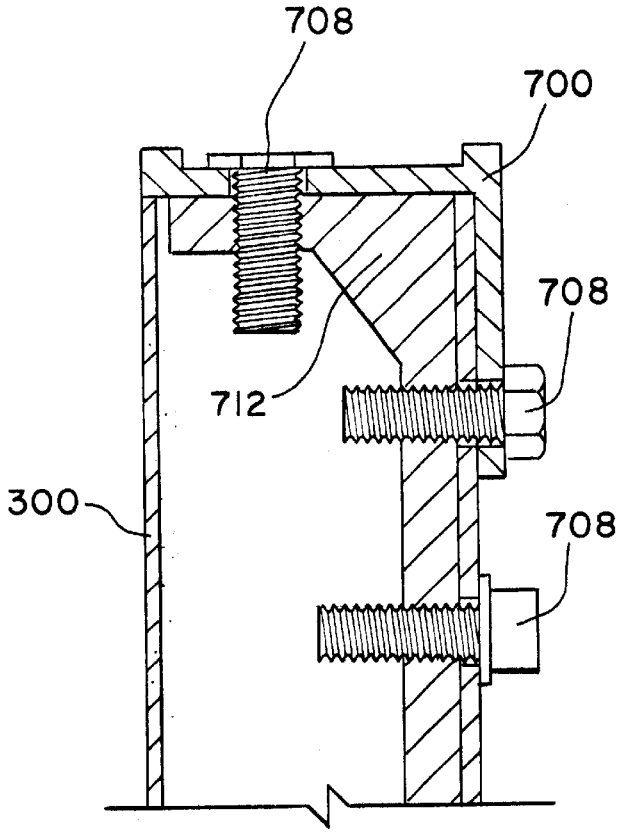
FIG. 20 is a cross-sectional view of the end of the aluminum improved insert and walers attached to a waler anchor plate.

The metal waler 700 preferably has a right-angle or L shape. Openings 710 are formed at predetermined positions in the sides of the metal waler 700. One side of the metal waler 700 extends over the end of the aluminum insert 300, as shown in FIG. 20, while the other side of the waler 700 extends adjacent to the second side 304 of the aluminum insert 300 (see FIG. 20). The extension of the metal waler 700 over the open end of the aluminum insert 300 is preferable in that it prevents cement from entering into the hollow interior 340 of the aluminum insert 300.

Figure 19:
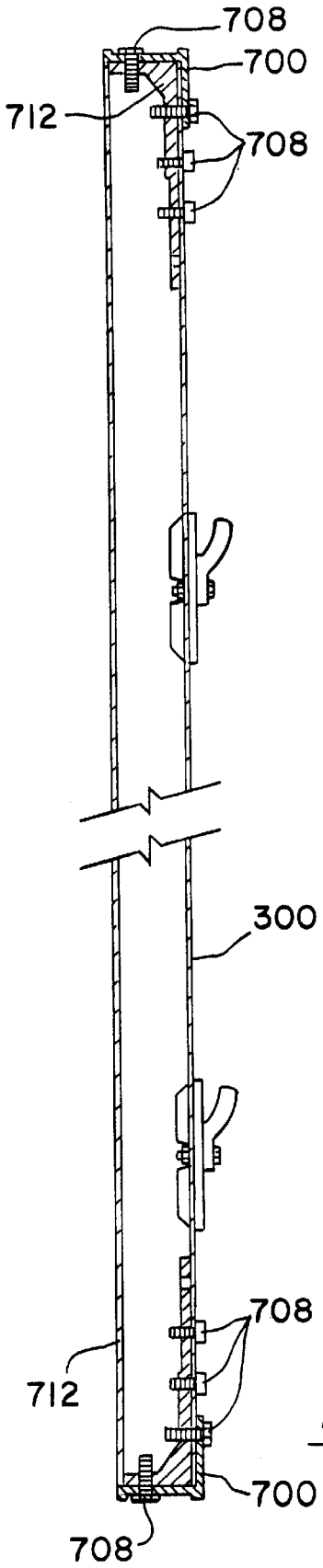
FIG. 19 is a cross-sectional view of the aluminum improved insert and walers.
Figure 21:
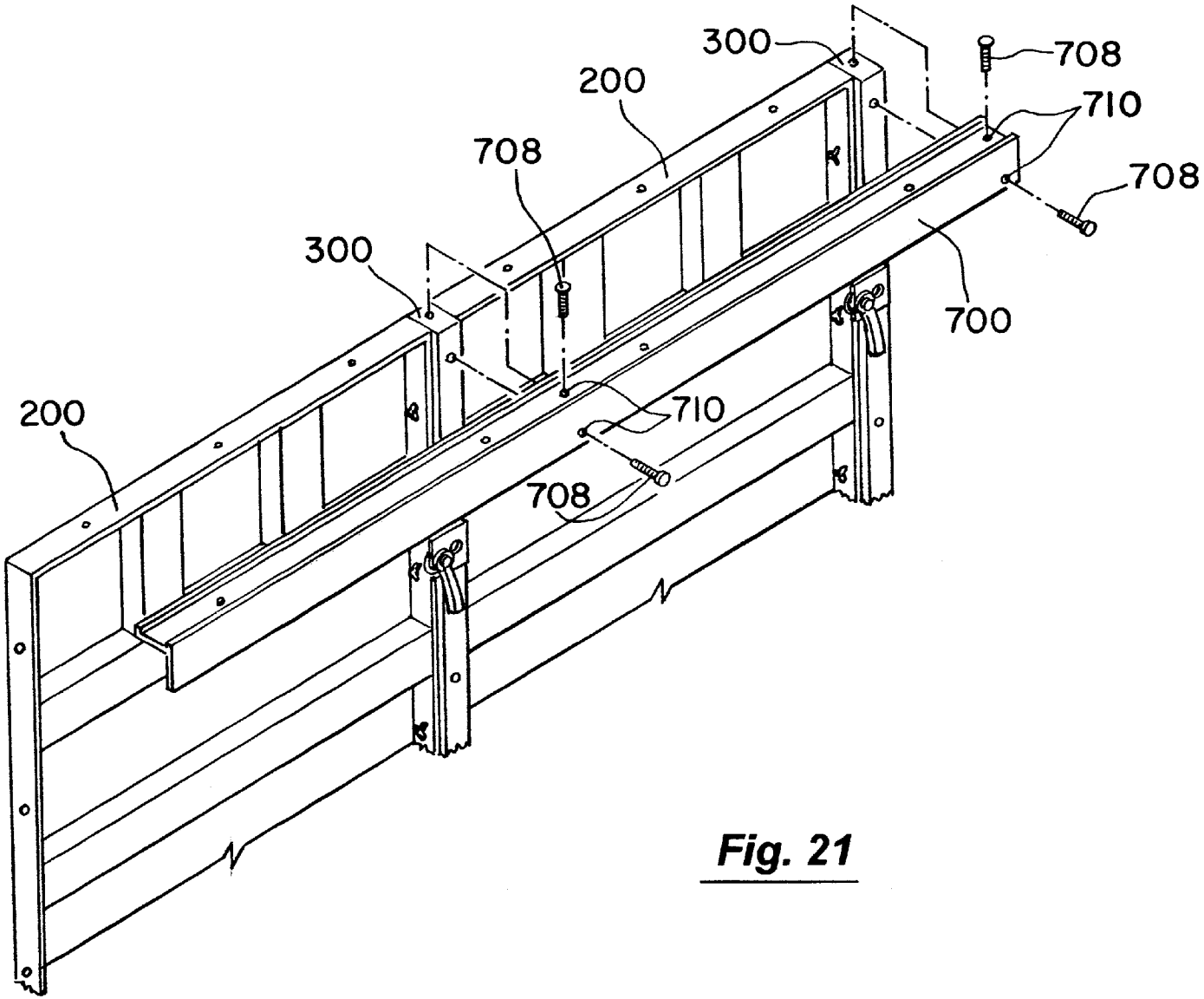
FIG. 21 is a perspective view of a gang form with aluminum improved inserts showing the attachment of a waler.

The metal waler 700 is attached to the aluminum insert 300 by first attaching a waler anchor plate 712 in the hollow interior 340 of the aluminum waler 300 with at least one attachment device 708 as shown in FIGS. 19 and 20. The waler anchor plate 712 is preferably made of cast steel that is plated to prevent rust. (The waler anchor plate 712 can also act as an end 316 on which to anchor a pick-up loop 602 if desired.) A metal waler 700 is then placed over the end of and adjacent to the second side 304 of the aluminum insert 300 and attached to the waler anchor plate 712 with at least one attachment device 708 as shown in FIG. 21. It is to be understood that the metal waler 700 could be attached directly to the aluminum insert 300 if desired. The attachment devices 708 are preferably bolts; other attachment devices will be evident to those skilled in the art.

When it is desired to stack a gang form 100 atop a second gang form 100, for example, to provide a concrete form system 10 to make a tall wall, various methods of splicing the improved inserts 300 can be used. A preferred method is shown in FIGS. 22 and 23. A splice box 1300 is preferably used to splice together the gang forms 100. Such splicing is preferably done after the gang forms 100 have been built. First, the splice box 1300 is attached with attachment devices 318, preferably bolts 320 and nuts 322, to the second side 304 at the end of a first improved insert 300 in a gang form 100. This attachment is preferably done to a waler anchor plate 712 previously attached to the interior of the improved insert 300 as described above. Then, the end of the first improved insert 300 is juxtaposed to the end of a second improved insert 300 (also preferably having a waler anchor plate 712 attached) in a second gang form 100, as shown in FIG. 22. The splice box 1300 is then attached by attachment devices 318 to the second side 304 of the second improved insert 300, forming a stable joint.

In a preferred embodiment, the splice box 1300 comprises two compartments 1302 and 1304 to provide strength without weight, as shown in FIG. 23. The second compartment 1304 is open ended, and flanges 1306 extend into the interior. The flanges 1306 are juxtaposed to the second side 304 of the improved insert 300 when the splice box 1300 is attached to the improved insert 300 and assist in supporting the splice box 1300 against the improved insert 300. The ends of the walls of the open-ended second compartment 1306 are juxtaposed against the flanges 330 of the improved insert 300, again assisting in supporting the splice box 1300 and spreading across a wider area the forces that occur when concrete is poured into the concrete form system 10. The second compartment 1304 enables the splice box 1300 to be placed over any attachment devices 708, such as bolts, whose heads stick out above the second side 304 of the aluminum improved insert 300.

3. Method for providing the gang form 100. It is advantageous in the present invention to provide a method by which a gang form 100 can be built by one person. A preferred method to do so follows.

First, a jig table 1000 as shown in FIG. 12 is provided so that a smooth surface is provided on which to place the components of the gang form 100. The jig table 1000 has a predetermined size that is based on the desired size of the gang form 100 to be built. For example, in FIG. 12, the jig table 1000 is sized for a gang form 100 having three adjacent form panels 200.

Next, at least two form panels 200 as described above are placed on the jig table 1000 so that the forming surfaces 202 face down abutting the surface of the jig table 1000. An improved insert 300 as described above is then positioned between the two adjacent form panels 200 so that the first side 302 of the insert 300 abuts the surface of the jig table 1000 and is thus automatically aligned with the forming surfaces 202 of the adjacent form panels 200. The insert 300 is positioned so that the side openings 310 in the third 306 and fourth 308 sides are aligned with the flange openings 206 in the adjacent flanges 204.

A sleeve 1200 is inserted into at least one tie rod opening 312 of the improved insert 300 so that said sleeve 1200 extends between the first side 302 and the second side 304 of the improved insert 300. Alternatively, the sleeve 1200 can be inserted into the tie rod opening 312 before the improved insert 300 is positioned between the two form panels 200.

The two adjacent form panels 200 are then moved toward the improved insert 300 positioned therebetween as shown by arrows 1002 in FIG. 12*b*. Attachment devices 318, preferably bolts 320 and nuts 322, are inserted through the flange openings 206 and the side openings 310 and tightened in order to attach the improved insert 300 to the two adjacent form panels. Thus, the gang form 100 is provided.

If the pick-up member 600 is not already attached, the pick-up member 600 is attached to the end 316 of the insert. The gang form 100 thus provided is then lifted off the jig table 1000 with the pick-up member 600. This is preferably done by using a crane or other lifting device attached to the pick-up member 600. Once the gang form 100 is in a vertical position, one of a plurality of tie rods 400 is inserted into a tie rod opening 312 and secured with the attached lock member 500 to the insert 300. This step is repeated until the desired number of tie rods 400 are secured to the insert 300, and the gang form 100 is ready to be interconnected with other gang forms 100 to provide a concrete form system 10. At that time, scaffold brackets 800 and double walers 700 are attached to the gang form 100 if desired.

After the concrete is poured and hardens, one end of each tie rod 400 is unlocked from one of the opposing gang forms 100 in the concrete form system 10, and the gang form 100 is lifted away from the new concrete wall. The gang form 100 can be reused to build many concrete walls.

Thus, a reusable gang form 100 with an improved insert 300 has been provided for use in a concrete form system 10. The gang form 100 is easily built and moved by one person. Once the gang form 100 is built, there are no loose pieces that must be attached to the gang form 100 to enable its use. The gang form 100 can be interconnected to the concrete form system 10 using many types of conventional tie rods 400. Damage to the gang form 100 of the present invention is minimal during use, and thus the gang form 100 can be reused many times, resulting in significantly less expense to the contractor.

Figure 25A:
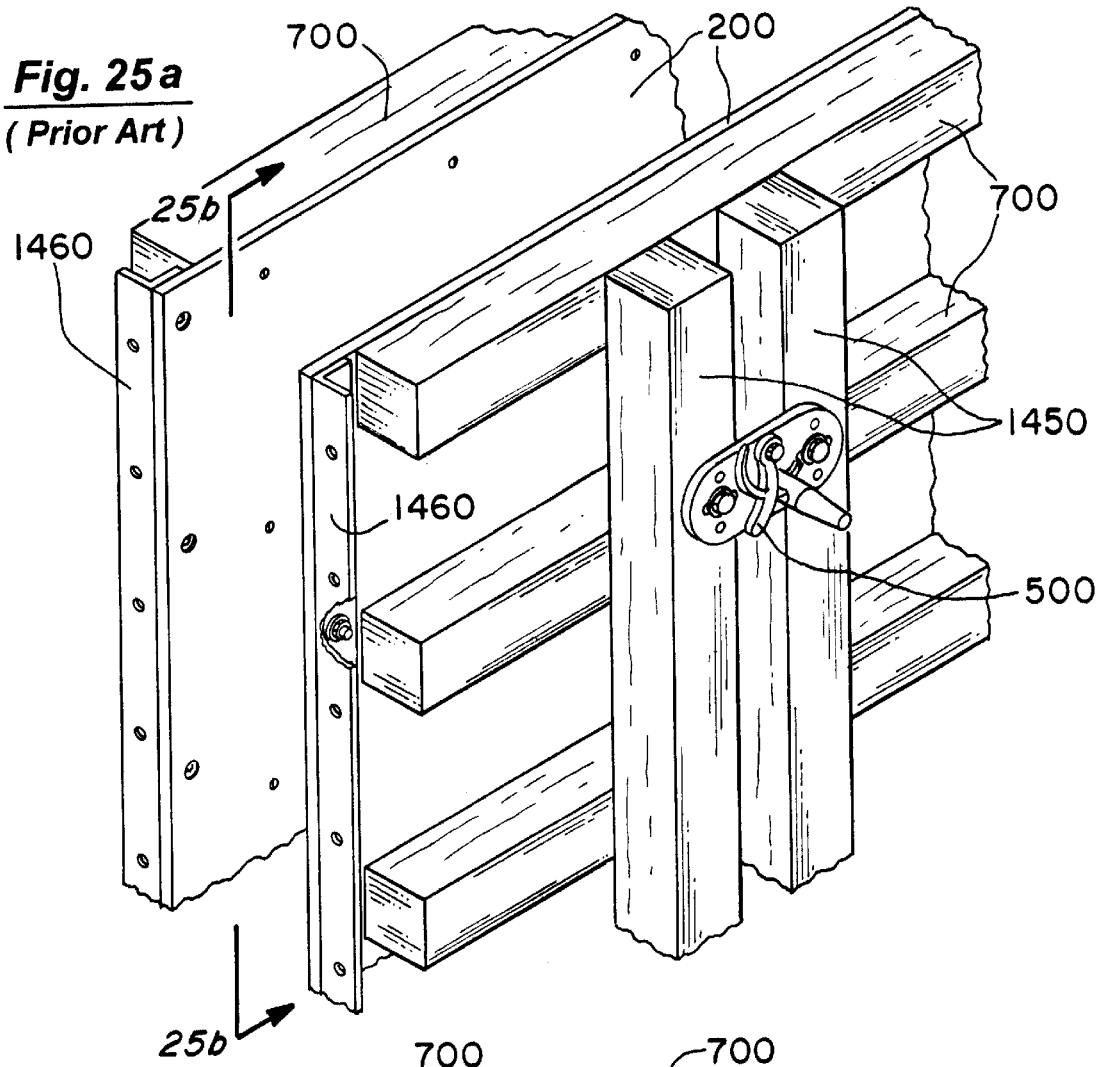
Fig. 25a ( Prior Art )
FIGS. 25A and 25B illustrate the prior art of providing a gang form with stiff backs and walers.
Figure 25B:
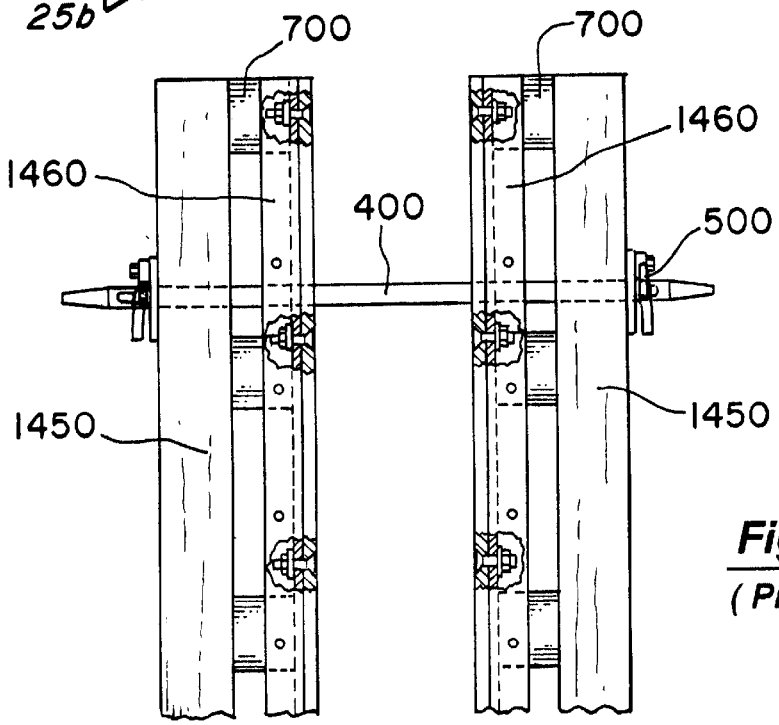
Fig. 25b ( Prior Art )
Figure 26:
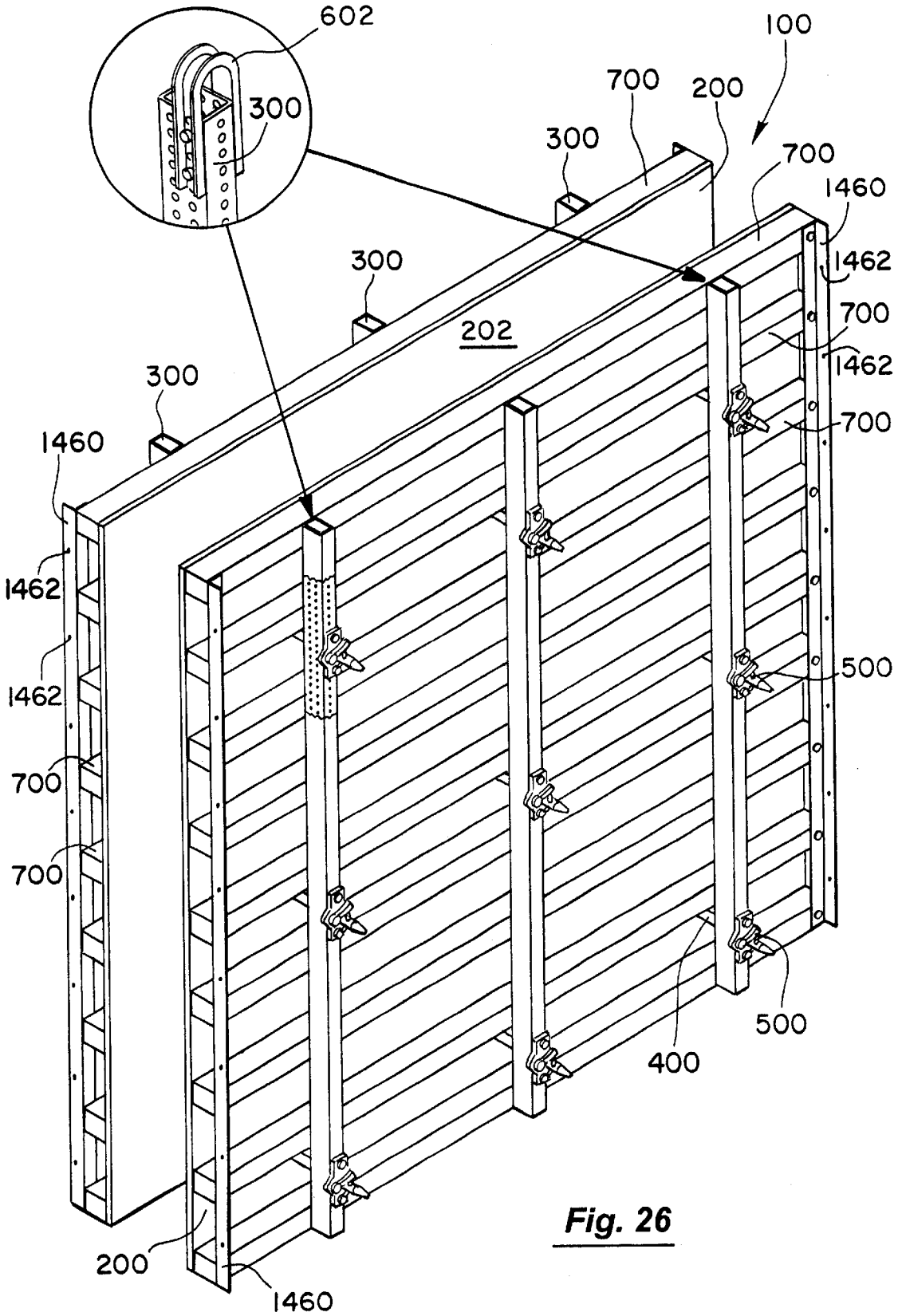
FIG. 26 is a perspective view of a gang form provided by a new method.

In a second preferred embodiment, another method of providing a gang form 100 using the improved insert 300 is available. This second preferred embodiment is advantageous over the first preferred embodiment described hereinabove in that it permits a gang form 100 to be provided without the use of a jig table, and using only two types of attachment devices 318. These are advantages that are also found over the prior art as shown in FIGS. 25A and 25B. The second preferred embodiment further differs from the first preferred embodiment in that the improved inserts 300 are not inserted between the form panels 200, thus removing the need for time spent attaching the improved inserts 300 directly to the form panels 200 with a plurality of easily misplaced attachment devices. Gang forms 100 provided by this second preferred embodiment are illustrated in FIG. 26.

Figure 32:
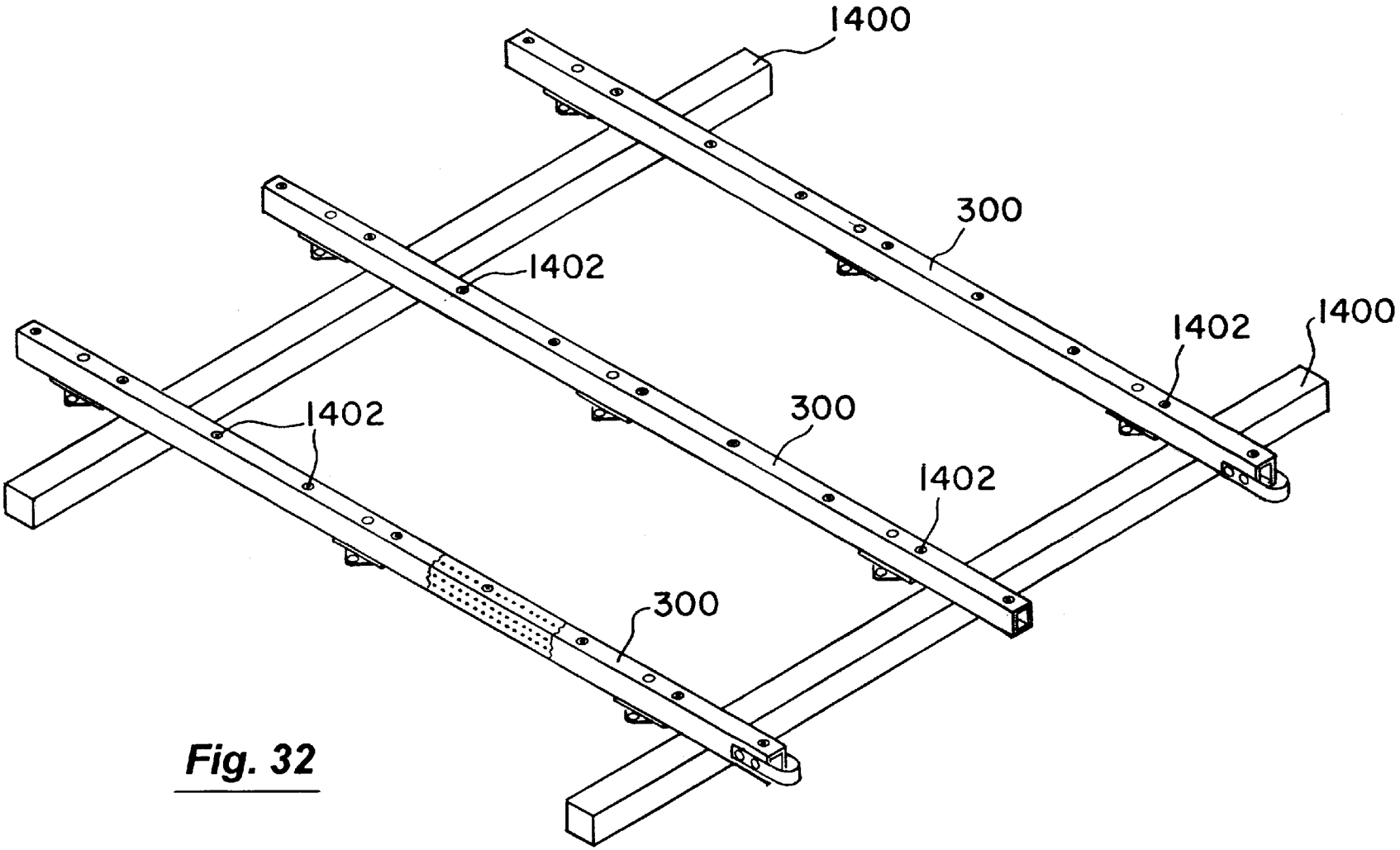
FIG. 32 is a perspective view illustrating the first step of an alternative embodiment of a method of providing a gang form.

The second method comprises the following steps, as shown in FIGS. 32 through 36. (a) At least two supports 1400 are provided. These supports 1400 can be placed directly on the ground at a building site if desired. The supports 1400 are preferably 4×4 wood lengths, but other suitable materials can be used, as will be known by those skilled in this art. The supports 1400 are preferably placed parallel to each other, as shown in FIG. 32.

(b) Next, at least two improved inserts 300 are positioned on top of the supports 1400 and extend across the supports 1400 at right angles to the supports 1400, as shown in FIG. 32. As in the first embodiment, the improved inserts 300 have a first side 302 and a second side 304 opposing the first side 304. The first side 302 and the second side 304 have openings 310 formed therein. The improved inserts 300 are positioned such that the second side 304 is adjacent to the supports 1400 when the improved inserts 300 are positioned on top of the supports 1400. The improved inserts 300 further have at least one tie rod opening 312 formed in the first side 302 and the second side 304. The improved inserts 300 further comprise at least one lock member 500 rotatably attached at a predetermined location to the second side 304 adjacent to the at least one tie rod opening 312, the at least one lock member 500 being rotatable between an unlocked position and a locked position.

Figure 28:
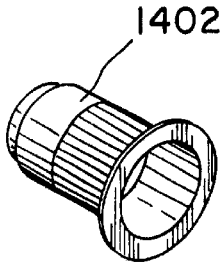
FIG. 28 is a perspective view of a nutsert.
Figure 29:
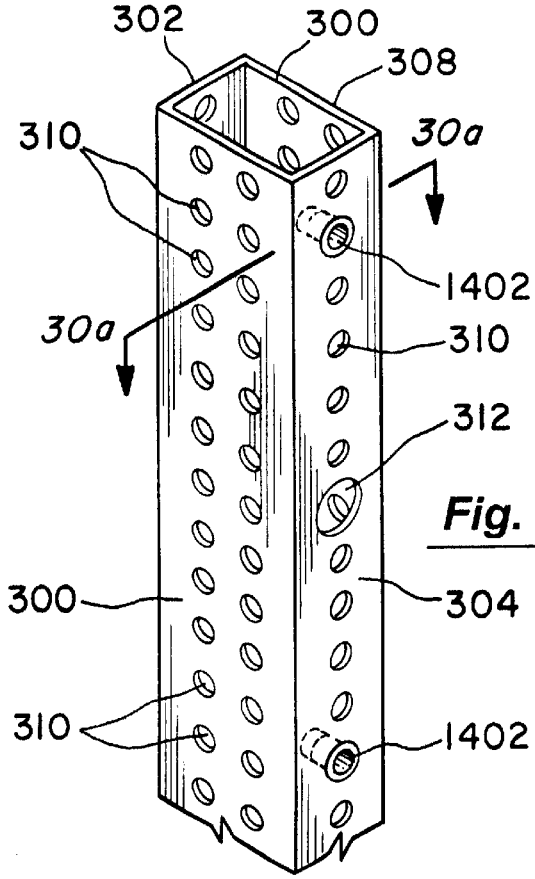
FIG. 29 is a perspective view of an improved insert having side openings and comprising nutserts inserted in the side openings.

Of importance to the present invention, the improved inserts 300 comprise nutserts 1402 (see FIG. 28) inserted into a plurality of the side openings 310 on the first side 302, as shown in FIG. 29. A cross section of a nutsert 1402 inserted in the first side 302 is shown in FIG. 30A. The nutsert 1402 is preferably a metal device having a threaded interior surface adjacent to a non-threaded surface 1404, as shown in FIG. 30A. The use of the nutsert 1402 will be described below.

Figure 33:
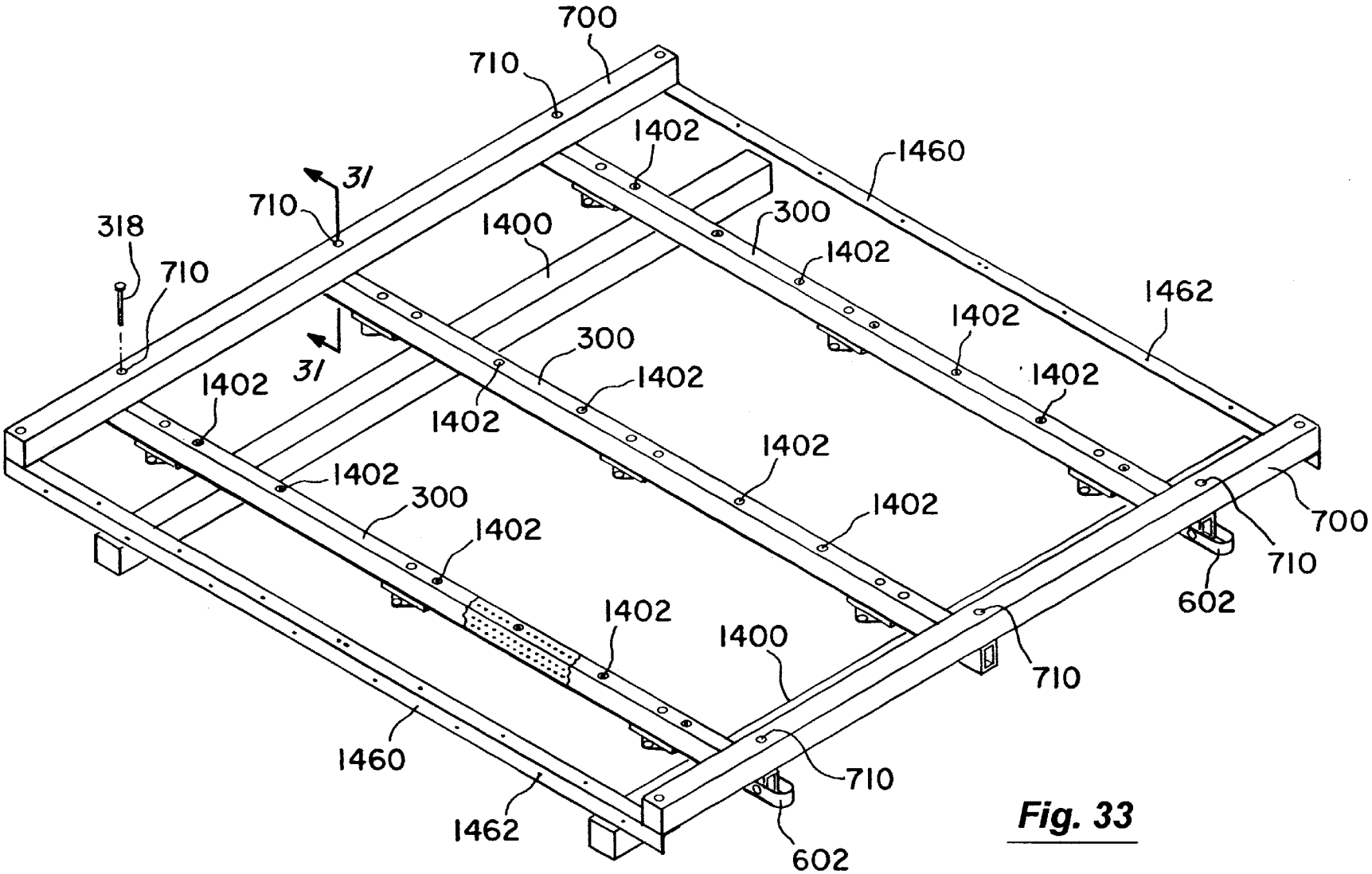
FIG. 33 is a perspective view illustrating the second step of the alternative method of providing a gang form.

In the next step, (c) at least two splices 1460 having splice openings 1462 formed therein are attached to at least two walers 700 having waler openings 710 therein by inserting attachment devices 318 through the splice openings 1462 and into the waler openings 710. The splices 1460 are preferably attached to the walers 700 to form a square, as shown in FIG. 33. Then, (d) the at least two walers 700 attached to the at least two splices 1460 are placed atop the at least two improved inserts 300 as shown in FIG. 33 so that the walers 700 extend across the improved inserts 300 at right angles thereto.

The at least two walers 700 are attached to the at least two improved inserts 300 by inserting attachment devices 318 (preferably bolts) through the waler openings 710 and into the nutserts 1402, as shown in FIG. 31. As the attachment devices 318 are threaded onto the threads in the nutserts 1402, the nutserts 1402 collapse (see FIG. 30B) at the non-threaded portion 1404, pulling the improved insert 300 tightly against the waler 700, as can be seen in FIG. 31. Once the nutsert 1402 has collapsed, the improved insert 300 will remain tightly attached to the walers 700. The use of the nutsert 1402 allows a single person to easily attach and detach the walers 700 to the inserts 300 without the need for a nut 322 to hold the bolt 320 to the waler 700. Thus, fewer loose parts are needed to provide a gang form 100. This is a distinct advantage over the prior art.

Figure 34:
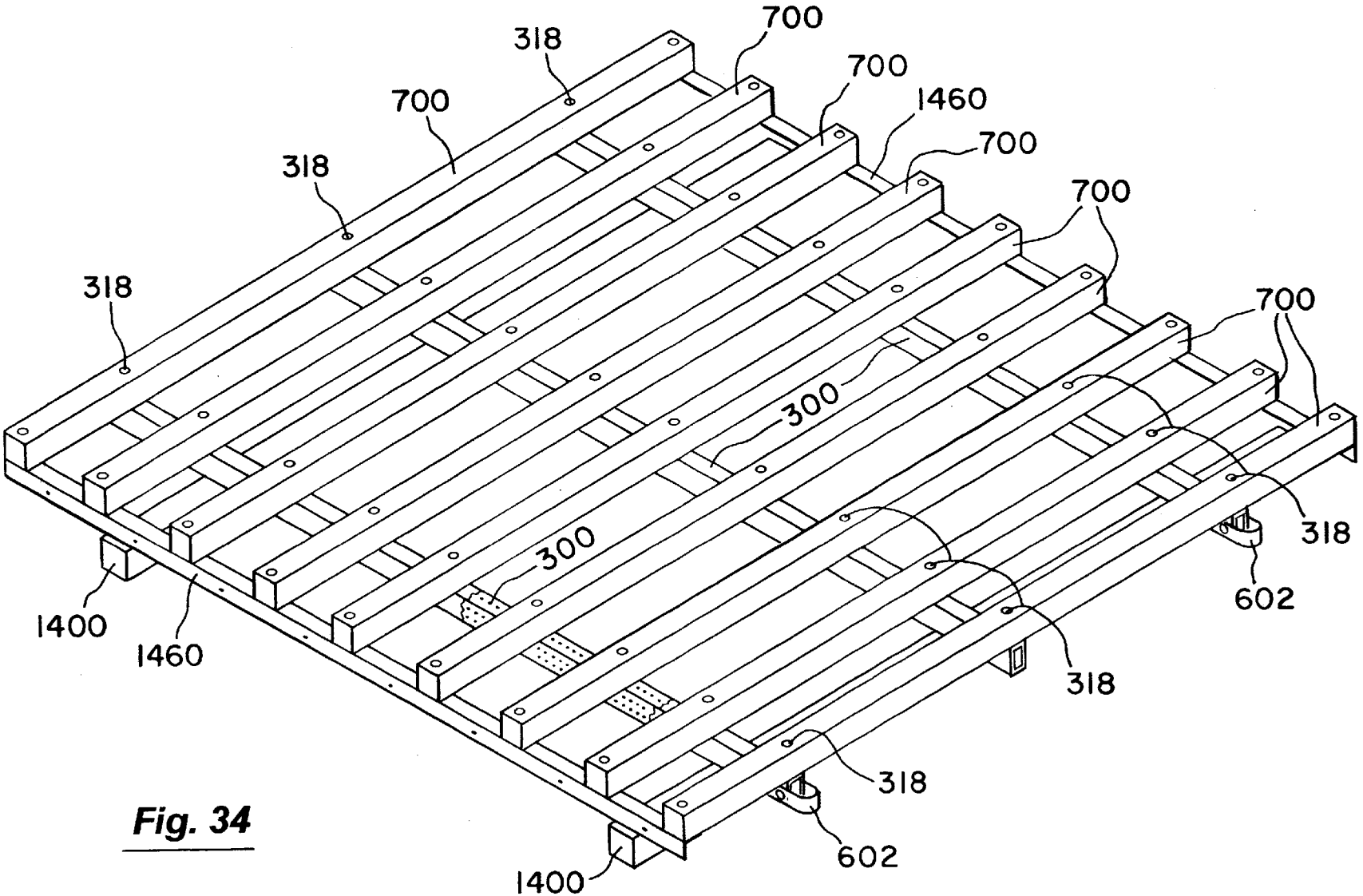
FIG. 34 is a perspective view illustrating the third step of the alternative method of providing a gang form.
Figure 35:
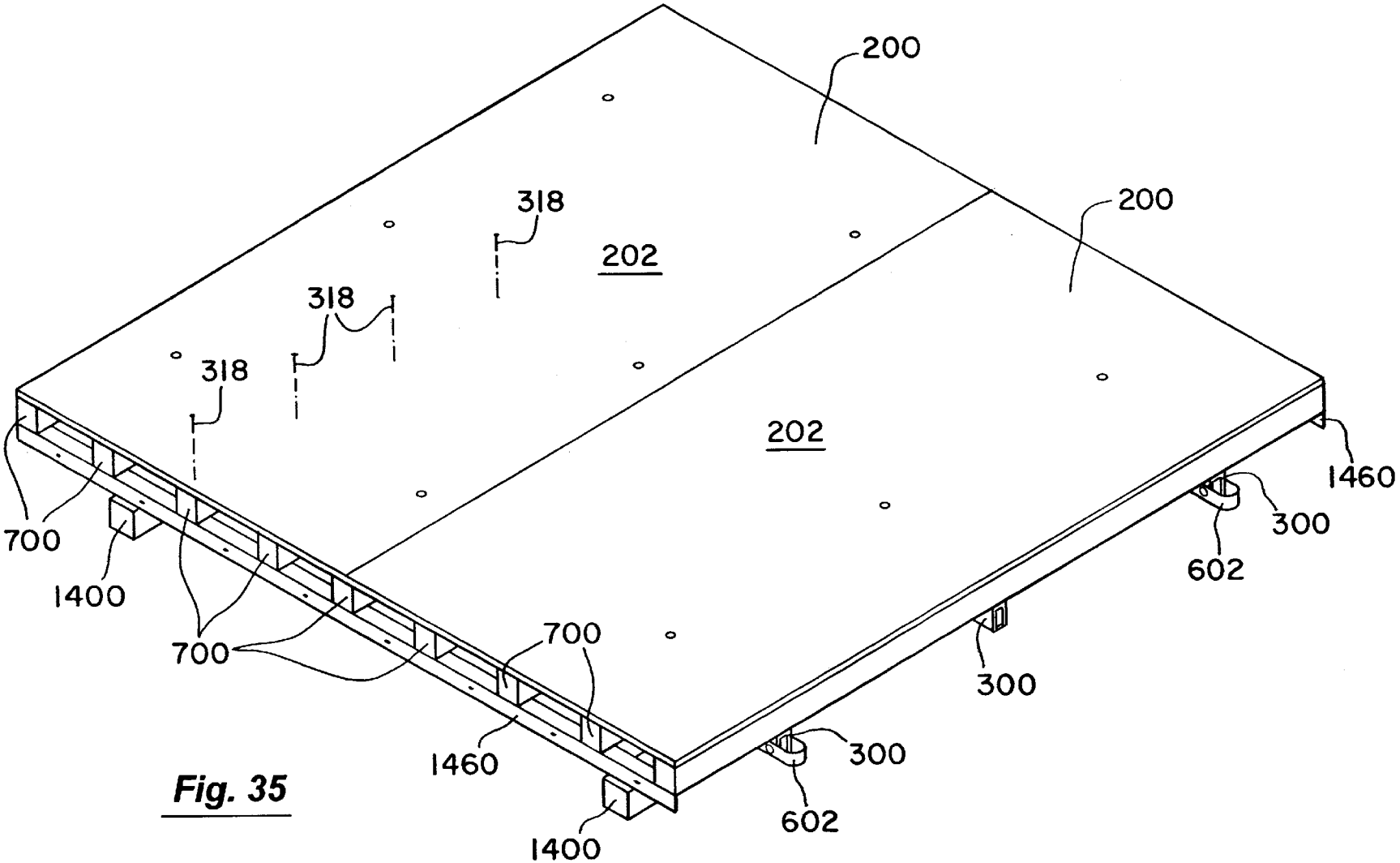
FIG. 35 is a perspective view illustrating the fourth step of the alternative method of providing a gang form.

Next, (e) a plurality of walers 700 having openings 710 therein are placed atop said at least two improved inserts 300, extending across the improved inserts 300 between the first at least two walers 700, as shown in FIG. 34. The plurality of walers 700 are attached to at least two improved inserts 700 as described above by inserting attachment devices 318 through said openings 710 in said plurality of walers 700 and into said nutscrts 1402. The plurality of walers 700 are also attached to the at least two splices 1460 with attachment devices 318.

Then, (f) a form panel 200 having form openings therein and having at least one tie rod opening 208 therein is positioned atop the plurality of walers 700, said form panel 200 having a forming surface 202, so that the at least one tie rod opening 208 in the form panel 200 is aligned with the at least one tie rod opening 312 in the improved inserts 300. Since the attachment devices 318 attaching the walers 700 to the improved inserts 300 are countersunk into the walers 700, as shown in FIG. 31, the form panel 200 is positioned flush on the walers 700.

(g) The form panel 200 is then attached to the plurality of walers 700 by inserting attachment devices 318 through the form panel 200 and into the waler openings 710 in the walers 700, so that the gang form 100 is provided.

Figure 27:
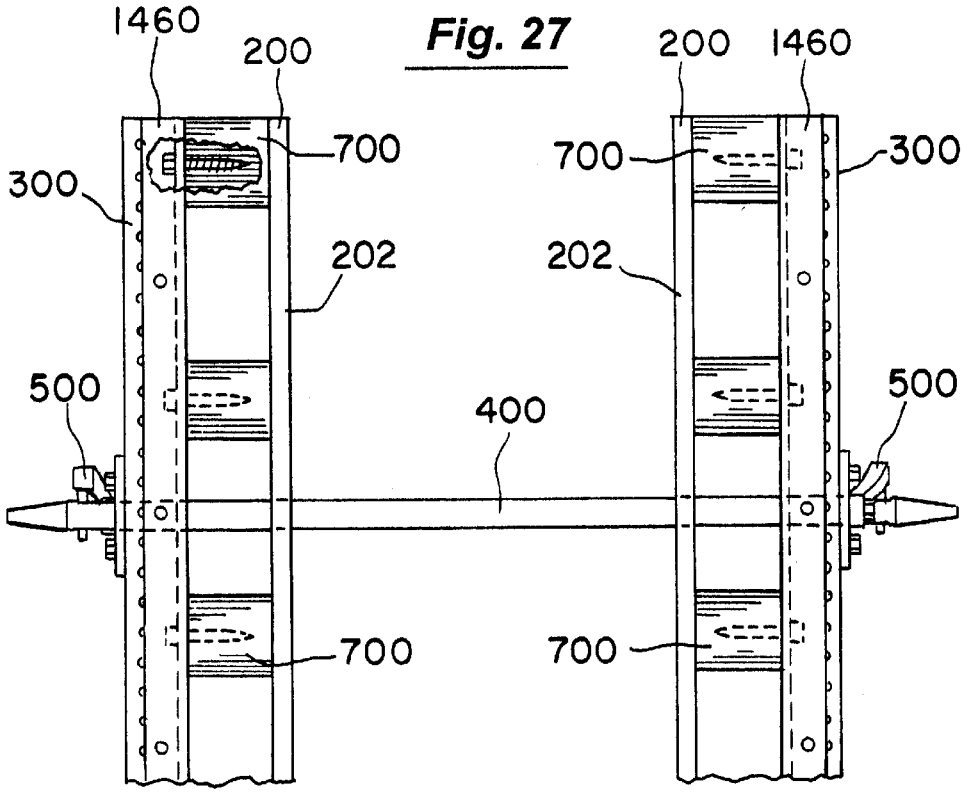
FIG. 27 is a cross-sectional view of the gang form of FIG. 26.
Figure 37:
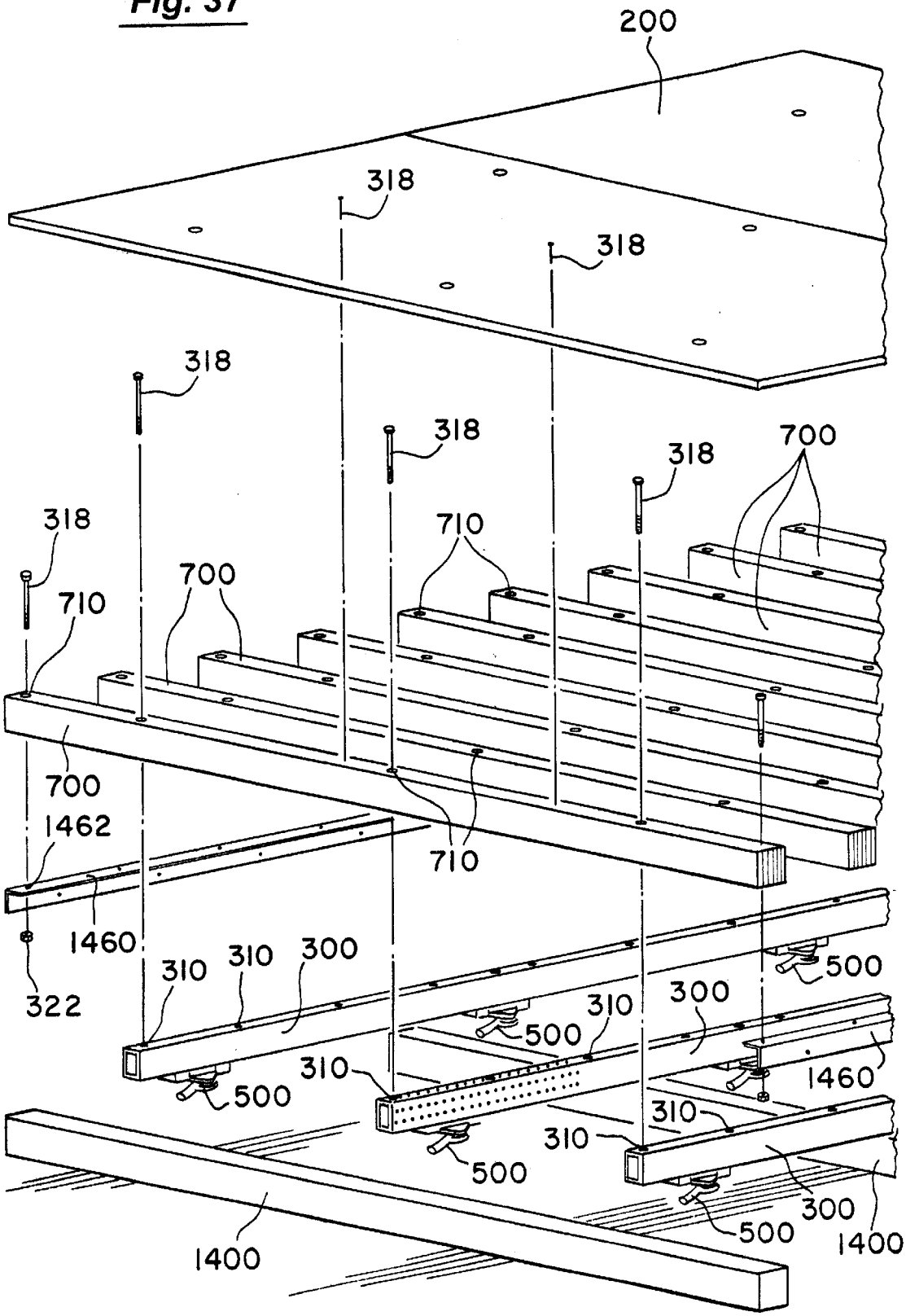
FIG. 37 is an exploded perspective view illustrating the alternative method of providing a gang form.

An exploded view of the gang form 100 provided by the above-described method is illustrated in FIG. 37, and a cross-sectional view is shown in FIG. 27, so that the relationships between the elements in the gang form 100 made by the second embodiment of the method can be more easily seen.

If a pick-up member 602 is not already attached, a pick-up member 602 is attached to the end of the improved insert 300 as shown in FIG. 26. The gang form 100 thus provided is (h) lifted to a vertical position as described above.

Once the gang form 100 is in a vertical position, (i) one of a plurality of tie rods 400 is inserted into said at least one tie rod opening 312 in the improved insert 300, so that said one of said plurality of tie rods 400 extends through said at least one tie rod opening 312 beyond the second side 304 of the improved insert 300 and through the at least one tie rod opening 710 in the waler 700 and then through the at least one tie rod opening 208 in the form panel 200. (j) The tie rod 400 is then secured to the improved insert 300 by rotating the lock member 500 into the locked position as described previously above. This step is repeated until the desired number of tie rods 400 are secured to the improved insert 300 and the gang form 100 is ready to be interconnected with other gang forms 100 as described below to provide a concrete form system 10.

Figure 36:
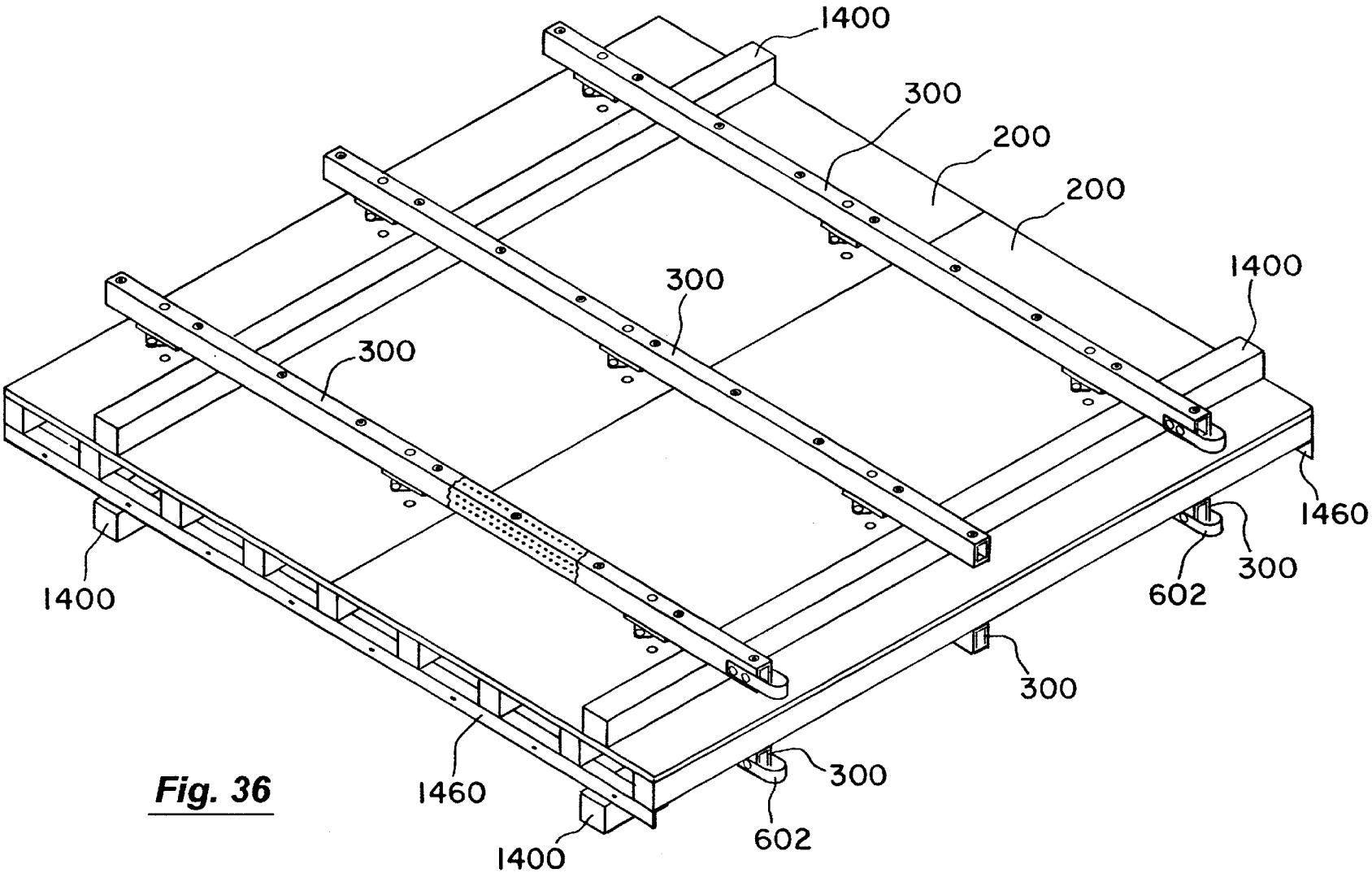
FIG. 36 is a perspective view illustrating an additional step of the alternative method of providing a gang form.

If it is desired to provide more gang forms 100, this method can further comprise repeating steps (a) through (g), wherein in step (a), the supports 1400 are positioned on top of said at least one form panel 200 of step (g), as shown in FIG. 36.

Figure 38:
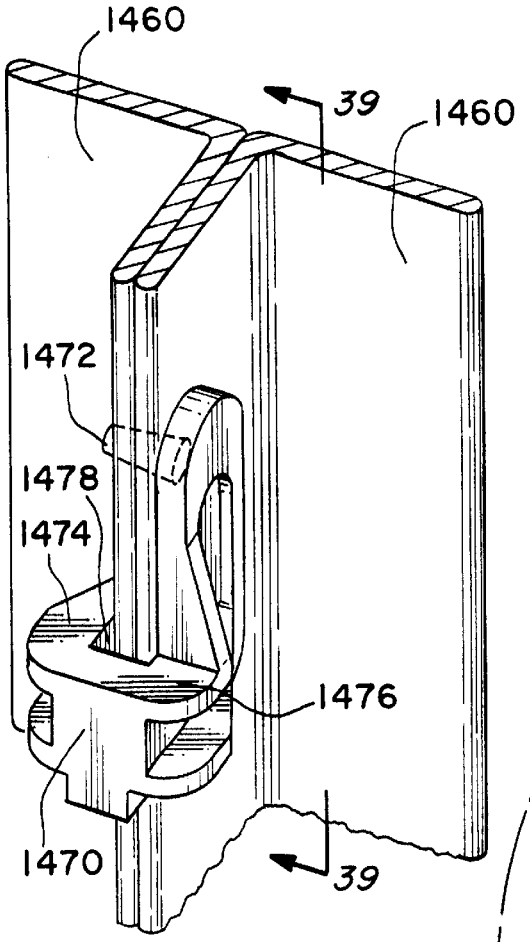
FIG. 38 is a perspective view illustrating a splice joiner joining splices.
Figure 39:
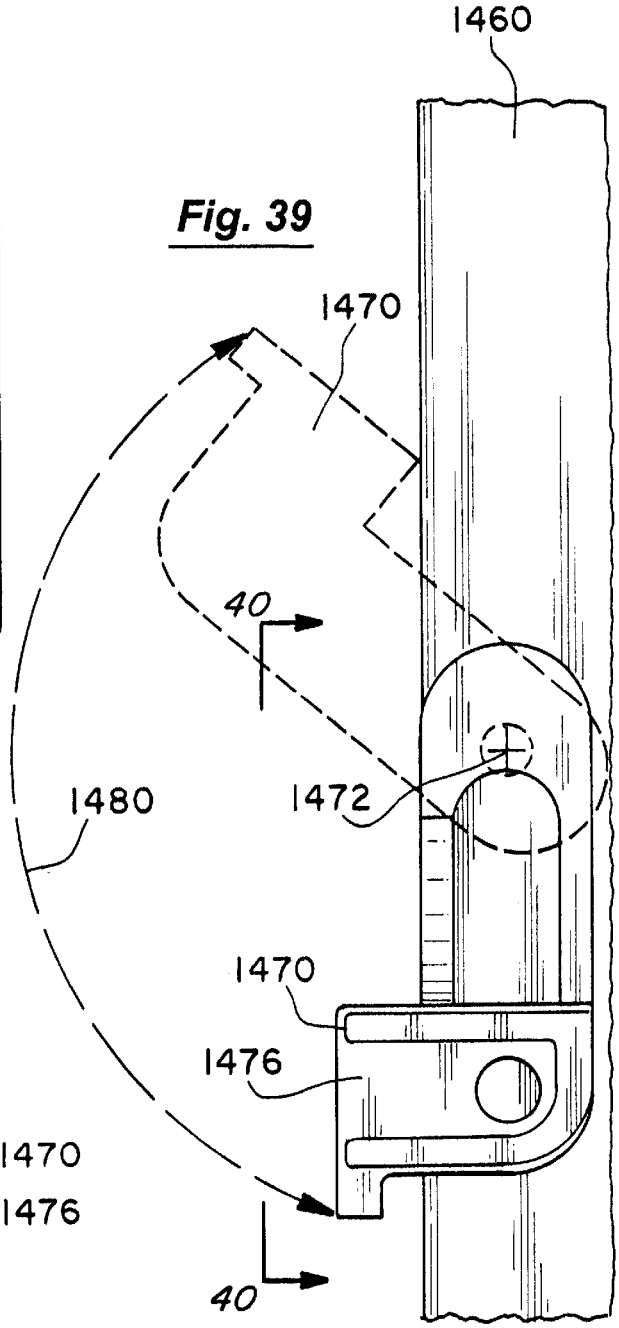
FIG. 39 is a side elevational view showing a splice joiner joining splices.
Figure 40:
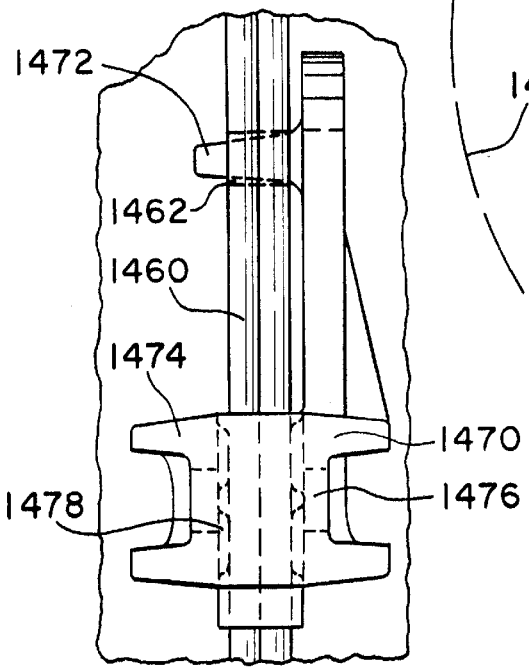
FIG. 40 is a front elevational view showing a splice joiner joining splices.

In order to join a gang form 100 to another gang form 100, as might be desired to provide a concrete form system 10, the splices 1460 can be juxtaposed and attached to each other as follows. The method of providing a gang form 100 described above further comprises the steps of (k) providing a splice joiner 1470, the splice joiner 1470 comprising a body 1476, a plug 1472 attached to the body 1476, and an arm 1474 attached to the body 1476 below the plug 1472. The arm 1474 forms a space 1478 between the body 1476 and the arm 1474. (l) The splices 1460 of at least two of the gang forms 100 are placed in a juxtaposed position as shown in FIG. 38, so that the splice openings 1462 are aligned. (m) The plug 1472 is inserted through the splice openings 1462, as shown in FIG. 39, and (n) the body 1476 of the splice joiner 1470 is rotated 1480 vertically downward, so that the splices 1760 are inserted into the space 1478 between the arm 1474 and the body 1476 of the splice joiner 1470, firmly holding the splices 1460 juxtaposed, as shown in FIG. 40.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable other skilled in the art to utilize the invention as such, or in other embodiments, and with the various modifications required by their particular application or uses of the invention. It is intended that the appended claims be construed to include alternate embodiments to the extent permitted by the prior art.

I claim:

1. A gang form for use with a concrete form system, said concrete form system having a plurality of said gang forms interconnected with a plurality of tie rods, said gang form comprising:

two adjacent form panels, each of said adjacent form panels having forming surfaces;

flanges attached to each of said two adjacent form panels, said flanges extending in a direction away from and perpendicular to said forming surfaces, said flanges having flange openings formed therein;

an improved insert, said improved insert comprising:

a first side and a second side opposing said first side;

a third side and a fourth side opposing said third side; said third side and said fourth side having side openings formed therein aligned with said flange openings in said flanges;

said improved insert positioned between said flanges of said two adjacent form panels to align said first side with said forming surfaces and to place said third side and said fourth side adjacent to said flanges of said two adjacent form panels;

attachment devices inserted through said flange openings and through said side openings to attach said improved insert to said flanges;

said first side and said second side of said improved insert having at least one tie rod opening formed therein at a predetermined location;

a sleeve inserted into said at least one tie rod opening and extending across said improved insert from said first side to said second side, said sleeve having an inside surface and an outside surface; and at least one lock member rotatably attached to said second side of said improved insert at a predetermined location adjacent to said at least one tie rod opening, said at least one lock member rotatable between an unlocked position and a locked position;

one of said plurality of tie rods extending through said at least one tie rod opening and through said sleeve beyond said second side of said improved insert, said one of said plurality of tie rods firmly secured to said improved insert by said at least one lock member when said at least one lock member is rotated to said locked position, so that said gang form is interconnected with said concrete form system.

2. The gang form of claim 1 wherein said sleeve further comprises a lining adjacent to said inside surface of said sleeve.

3. The gang form of claim 2 wherein said lining is tapered.

4. The gang form of claim 1 further comprising at least one plate attached to said second side of said improved insert at a predetermined location, said at least one plate having a front side and a rear side, said at least one plate having a plate opening formed therein aligned with said at least one tie rod opening in said second side, said one of said plurality of tie rods extending through said tie rod opening and said plate opening beyond said second side of said improved insert, and wherein said at least one lock member is rotatably attached to said front side of said at least one plate at a predetermined location adjacent to said plate opening, said at least one plate having at least one flange attached to said back side of said plate adjacent to said improved insert, said at least one flange extending along at least one of said sides of said improved insert.

5. The gang form of claim 1 further comprising at least one scaffold bracket attached to said third side and said fourth side of said improved insert.

6. The gang form of claim 1 wherein said improved insert comprises a first flange extending along said third side and a second flange extending along said fourth side of said improved insert.

7. The gang form of claim 6 wherein said flanges have a flat face.

8. The gang form of claim 6 wherein said flanges have a concave face.

9. The gang form of claim 6 further comprising a splice box attached adjacent to said flanges and extending along said second side of said improved insert.

10. The gang form of claim 1 wherein said improved insert is aluminum.

11. The gang form of claim 10 wherein said aluminum improved insert further comprises:

an interior having corners; and projections extending from said corners into said interior.

12. The gang form of claim 10 further comprising:

at least one waler anchor plate attached to said second side of said aluminum improved insert inside said interior near at least one end of said aluminum improved insert; and at least one waler attached to said at least one waler anchor plate.

13. A method for providing a gang form for use in a concrete form system, said concrete form system having a plurality of tie rods, said method comprising the steps of:

(a) providing a table having a predetermined size;

(b) placing two form panels, each of said two form panels having forming surfaces, adjacent on said table so that said forming surfaces abut said table, each of said two adjacent form panels having flanges, said flanges extending in a direction away from and perpendicular to said forming surfaces, said flanges having flange openings formed therein;

(c) positioning a first improved insert having an end between said flanges of said two adjacent form panels, said first improved insert having a first side and a second side opposing said first side and having a third side and a fourth side opposing said third side, said first improved insert positioned to align said first side with said forming surfaces and to place said third side and said fourth side adjacent to said flanges, said first improved insert having side openings formed in said third side and said fourth side aligned with said flange openings, said first improved insert further having at least one tie rod opening and at least one side opening formed in said first side and said second side, said first improved insert further having at least one lock member rotatably attached at a predetermined location to said second side adjacent to said at least one tie rod opening, said at least one lock member rotatable between an unlocked position and a locked position;

(d) inserting a sleeve into said at least one tie rod opening so that said sleeve extends between said first side and said second side of said first improved insert;

(e) attaching said first improved insert to said two adjacent form panels by inserting attachment devices through said flange openings in said flanges and through said side openings in said third side and said fourth side, so that said gang form is provided;

(f) lifting said first improved insert with said two adjacent form panels attached to a vertical position;

(g) inserting one of said plurality of tie rods through said sleeve in said at least one tie rod opening in said first improved insert, so that said one of said plurality of tie rods extends through said sleeve and through said at least one tie rod opening beyond said second side of said first improved insert; and (h) securing said one of said plurality of tie rods to said first improved insert by rotating said lock member into said locked position, so that said gang form is attached to said concrete form system.

14. The method for providing a gang form of claim 13 further comprising the steps of:

(i) positioning a splice box adjacent to said end of said first improved insert;

(j) attaching said splice box to said first improved insert;

(k) providing a second improved insert having an end adjacent to said end of said first improved insert;

(l) attaching said second improved insert to said first improved insert by attaching said splice box to said second side of said second improved insert.

15. The method of claim 14 further comprising the steps of:

(il) attaching a waler anchor plate to the interior of said first improved insert; and (kl) attaching a waler anchor plate to the interior of said second improved insert.

16. A method for providing a gang form for use in a concrete form system, said concrete form system having a plurality of tie rods, said method comprising the steps of:

(a) providing at least two supports;

(b) positioning at least two improved inserts on top of said supports and extending across said supports, said improved inserts having a first side and a second side opposing said first side, said first side and said second side having side openings formed therein, said improved inserts comprising nutserts inserted into a plurality of said side openings of said first side, said improved inserts positioned such that said second side is adjacent to said supports, said improved inserts further having at least one tie rod opening formed in said first side and said second side, said improved inserts further having at least one lock member rotatably attached at a predetermined location to said second side adjacent to said at least one tie rod opening, said at least one lock member rotatable between an unlocked position and a locked position;

(c) attaching at least two splices having splice openings formed therein to at least two walers having waler openings therein by inserting attachment devices through said splice openings and said waler openings;

(d) placing said at least two walers attached to said at least two splices atop said at least two improved inserts and extending across said improved inserts and attaching said at least two walers to said at least two improved inserts by inserting attachment devices through said waler openings in said walers and into said nutserts;

(e) placing a plurality of walers having openings therein atop said at least two improved inserts and extending across said improved inserts and attaching said plurality of walers to said at least two improved inserts by inserting attachment devices through said openings in said plurality of walers and into said nutserts and attaching said plurality of walers to said at least two splices;

(f) placing a form panel having at least one tie rod opening therein, atop said plurality of walers, said form panel having a forming surface, so that said at least one tie rod opening in said form panel is aligned with said at least one tie rod opening in said improved inserts;

(g) attaching said form panel to said plurality of walers by inserting attachment devices through said form panel and into said waler openings in said plurality of walers, so that said gang form is provided;

(h) lifting said gang form to a vertical position;

(i) inserting at least one of said plurality of tie rods into said at least one tie rod opening in said improved insert, so that said one of said plurality of tie rods extends through said at least one tie rod opening beyond said second side of said improved insert and through said at least one tie rod opening in said at least one form panel; and (j) securing said at least one of said plurality of tie rods to said improved insert by rotating said lock member into said locked position, so that said gang form is attached to said concrete form system.

17. The method of claim 16 further comprising repeating steps (a) through (g), wherein in step (a), said supports are positioned on top of said at least one form panel of the previous step (g).

* * * * *